US011772762B2

(12) United States Patent
Ariga

(10) Patent No.: US 11,772,762 B2
(45) Date of Patent: Oct. 3, 2023

(54) PROPELLER FOR VESSEL PROPULSION APPARATUS AND VESSEL PROPULSION APPARATUS

(71) Applicant: YAMAHA HATSUDOKI KABUSHIKI KAISHA, Iwata (JP)

(72) Inventor: Koma Ariga, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/831,468

(22) Filed: Jun. 3, 2022

(65) Prior Publication Data

US 2022/0402587 A1 Dec. 22, 2022

(30) Foreign Application Priority Data

Jun. 22, 2021 (JP) ..... 2021-103299

(51) Int. Cl.

| | |
|---|---|
| ***B63H 1/15*** | (2006.01) |
| ***B63H 23/06*** | (2006.01) |
| ***B63H 23/34*** | (2006.01) |
| ***B63H 23/30*** | (2006.01) |

(52) U.S. Cl.

CPC ..... *B63H 1/15* (2013.01); *B63H 23/06* (2013.01); *B63H 23/30* (2013.01); *B63H 23/34* (2013.01)

(58) Field of Classification Search

CPC . B63H 1/14; B63H 1/15; B63H 23/06; B63H 23/30; B63H 23/34; B63H 2023/342

See application file for complete search history.

(56) References Cited

U.S. PATENT DOCUMENTS

| | | | | |
|---|---|---|---|---|
| 6,386,350 | B1 * | 5/2002 | Sato | B63H 20/20 74/378 |
| 6,478,543 | B1 * | 11/2002 | Tuchscherer | B63H 23/34 416/134 R |
| 7,086,836 | B1 * | 8/2006 | Sheth | B63H 23/34 416/170 R |
| 2011/0212657 | A1 * | 9/2011 | Tsunekawa | B63H 23/34 440/49 |

(Continued)

FOREIGN PATENT DOCUMENTS

JP 2015-217893 A 12/2015

*Primary Examiner* — Christopher Verdier

(74) *Attorney, Agent, or Firm* — KEATING AND BENNETT, LLP

(57) ABSTRACT

A propeller includes a bushing, a propeller body, and a propeller damper. The bushing includes a first cylinder portion surrounding the propeller shaft and a first projection protruding outwardly in a radial direction of the propeller from an outer peripheral surface of the first cylinder portion. The propeller body includes a second cylinder portion surrounding the bushing and a second projection protruding inwardly in the radial direction from an inner peripheral surface of the second cylinder portion. The first and second projections are arranged along a rotation direction of the propeller. The propeller damper includes first and second dampers side by side along an axial direction of the propeller between the first and second cylinders. The first and second dampers are separated from each other by a separation portion, and are individually elastically deformable.

12 Claims, 12 Drawing Sheets

(56) References Cited

U.S. PATENT DOCUMENTS

| | | | | |
|---|---|---|---|---|
| 2014/0023503 | A1* | 1/2014 | Nakamura | B63H 21/34<br>416/135 |
| 2015/0336647 | A1* | 11/2015 | Ariga | B63H 23/34<br>416/146 R |
| 2019/0270501 | A1* | 9/2019 | Onoue | B63H 20/14 |

* cited by examiner

PROPELLER FOR VESSEL PROPULSION APPARATUS AND VESSEL PROPULSION APPARATUS

CROSS REFERENCE TO RELATED APPLICATIONS

This application claims the benefit of priority to Japanese Patent Application No. 2021-103299 filed on Jun. 22, 2021. The entire contents of this application are hereby incorporated herein by reference.

BACKGROUND OF THE INVENTION

1. Field of the Invention

The present invention relates to a propeller for a vessel propulsion apparatus, and to a vessel propulsion apparatus including the propeller.

2. Description of the Related Art

An outboard motor that is an example of a vessel propulsion apparatus includes an engine, a drive shaft that extends downwardly from a crank shaft of the engine, a propeller shaft that is coupled to the drive shaft through a forward/backward movement switching mechanism, and a propeller that is coupled to a rear end portion of the propeller shaft.

An example of the forward/backward movement switching mechanism includes a bevel gear that is coupled to a lower end of the drive shaft, a pair of front and rear bevel gears that always engage with the bevel gear, and a slider that slides on the propeller shaft and that selectively engages and interlocks with the pair of front and rear bevel gears. The pair of bevel gears rotate in mutually opposite directions around the propeller shaft. The slider is spline-engaged with the propeller shaft, and slides in the axial direction of the propeller shaft. When the slider engages and interlocks with neither of the pair of front and rear bevel gears, the shift position of the outboard motor is neutral. A state in which the slider engages and interlocks with either one of the pair of front and rear bevel gears is referred to as "shift-in."

When the slider engages and interlocks with either one of the pair of front and rear bevel gears and reaches a shift-in state, the rotation of the drive shaft is transmitted to the propeller shaft through the forward/backward movement switching mechanism, and therefore the propeller rotates and generates a forward or backward thrust. The slider forms a so-called dog clutch together with the pair of front and rear bevel gears. In some cases, the slider is referred to as "dog clutch." In this description, let it be supposed that a member (in the example mentioned above, the slider) that moves in the axial direction of a propeller shaft or the like for power transmission is referred to as "dog clutch."

A propeller described in Japanese Unexamined Patent Publication No. 2015-217893 includes a damper unit and a propeller member. The damper unit includes a cylindrical bushing that is spline-connected to the propeller shaft and a cylindrical propeller damper that surrounds the bushing. The propeller member includes an inner cylinder that surrounds the propeller damper, an outer cylinder that surrounds the inner cylinder, and a plurality of blades that extend outwardly from an outer peripheral surface of the outer cylinder.

A front end portion of an outer peripheral surface of the bushing protrudes forwardly from the propeller damper. A plurality of first projections are disposed at the front end portion at equal intervals between the projections in the rotation direction of the propeller. The propeller damper is made of an elastic material, and its inner peripheral surface is fixed to the outer peripheral surface of the bushing. The propeller damper includes a cylindrical first damper and a cylindrical second damper disposed behind the first damper. The propeller damper is an integrally-molded piece formed by molding the first and second dampers integrally with each other. A plurality of first transmission grooves that are arranged at equal intervals between the first transmission grooves in the rotation direction are provided at an outer peripheral surface of the first damper, and a plurality of second transmission grooves that are arranged at equal intervals between the second transmission grooves in the rotation direction are provided at an outer peripheral surface of the second damper. The first and second transmission grooves extend in a front-rear direction, and the groove width of the second transmission groove is larger than that of the first transmission groove.

A plurality of second projections are disposed at a front end portion of an inner peripheral surface of the inner cylinder of the propeller member at equal intervals between the second projections in the rotation direction. The first projection of the bushing and the second projection of the propeller member are alternately arranged in the rotation direction. A plurality of first transmission projections arranged at equal intervals between the first transmission projections in the rotation direction and a plurality of second transmission projections arranged at equal intervals between the second transmission projections in the rotation direction at a more rearward position than the first transmission projection are provided at the inner peripheral surface of the inner cylinder of the propeller member. The first transmission projections are press fitted into the first transmission grooves of the first damper one by one, and the second transmission projections are fitted in the second transmission grooves of the second damper one by one with a clearance in the rotation direction.

SUMMARY OF THE INVENTION

The inventor of preferred embodiments of the present invention described and claimed in the present application conducted an extensive study and research regarding a propeller for a vessel propulsion apparatus and a vessel propulsion apparatus, such as the one described above, and in doing so, discovered and first recognized new unique challenges and previously unrecognized possibilities for improvements as described in greater detail below.

When torque that relatively rotates the propeller shaft and the propeller member is generated, for example, by the operation of the engine or by contact between the propeller and an obstacle in the water, the propeller damper is twisted in the rotation direction, and, as a result, is elastically deformed. More specifically, if the magnitude of the torque is within a range less than a first torque, the first projection and the second projection that adjoin each other are in a non-contact state, and the second transmission projection is spaced away from a side surface of the second transmission groove. Therefore, the first damper is elastically deformed in the propeller damper, and the torque is transmitted between the bushing and the inner cylinder of the propeller member through the first damper. When the torque reaches the first torque, the second transmission projection comes into contact with the side surface of the second transmission groove although the first and second projections are in a non-contact state. This allows not only the first damper but also the second damper to be elastically deformed, and therefore the torque is transmitted between the bushing and the propeller member through both the first damper and the second damper. When the torque reaches a second torque larger than the first torque, the first projection and the second projection come into contact with each other (into so-called metal touch), and therefore the first and second dampers stop being elastically deformed. In this case, the torque is transmitted between the bushing and the propeller member through the first and second projections in addition to the first and second dampers.

When the vessel is trolling at a low speed and the vessel propulsion apparatus is in a shift-in state, there is a case in which the dog clutch and the bevel gear repeatedly make contact with and separate from each other because of a change in the rotation speed of the engine and, as a result, a so-called rattling noise occurs. The present inventor conducted a detailed study, and, as a result, discovered that a soft propeller damper, i.e., a propeller damper having a low elastic modulus is effective in preventing the rattling noise.

On the other hand, in the vessel propulsion apparatus, there is a case in which the phenomenon of a so-called shift shock occurs. The term "shift shock" denotes sounds and vibrations generated when a shift-in state is reached. The vessel propulsion apparatus being in a shift-in state is controlled so that engine output increases in order to drive the propeller that has stopped or in order to drive the propeller against the inertial force of the propeller that is inertially rotating. Thus, a torque greater than during trolling is generated. In the propeller damper whose elastic modulus has been reduced to prioritize the prevention of the rattling noise, the first and second projections come into contact with each other, and reach the "metal touch" before being elastically deformed until balancing the torque produced in a shift-in state. As a result, a sound caused by the metal touch becomes louder, or transmission torque is swiftly built up and, as a result sounds or vibrations are generated which make a user aware of the shift shock.

Neither the rattling noise nor the shift shock is a phenomenon that ruins the function of the vessel propulsion apparatus, and yet, if these are reduced, the user of the vessel can enjoy more comfortable sailing. Therefore, the reduction of both the rattling noise and the shift shock is a factor that improves the merchantability of the vessel propulsion apparatus.

Therefore, preferred embodiments of the present invention provide propellers for vessel propulsion apparatuses and vessel propulsion apparatuses that are each able to achieve compatibility in both preventing rattling noise and shift shock.

In order to overcome the previously unrecognized and unsolved challenges described above, a preferred embodiment of the present invention provides a propeller for a vessel propulsion apparatus to rotate together with a propeller shaft provided in a vessel propulsion apparatus. The propeller includes a bushing fixed to the propeller shaft, a propeller body, and a propeller damper. The bushing includes a first cylinder portion surrounding the propeller shaft and a first projection protruding outwardly in a radial direction of the propeller from an outer peripheral surface of the first cylinder portion. The propeller body includes a second cylinder portion, a second projection, a third projection, a fourth projection, and a plurality of blades. The second cylinder portion surrounds the bushing. The second projection protrudes inwardly in the radial direction from an inner peripheral surface of the second cylinder portion, and is located beside the first projection along a rotation direction of the propeller. The third projection protrudes inwardly in the radial direction from an inner peripheral surface of the second cylinder portion at a position different from a position of the second projection. The fourth projection protrudes inwardly in the radial direction from the inner peripheral surface of the second cylinder portion at a position different from the position of the second projection and from a position of the third projection with respect to an axial direction of the propeller. The plurality of blades are each located at a more outward position than the second cylinder portion with respect to the radial direction of the propeller, and the plurality of blades are arranged along the rotation direction. The propeller body is relatively movable in the rotation direction with respect to the bushing between a non-contact position at which the first projection and the second projection are spaced away from each other and a contact position at which the first projection and the second projection come into contact with each other. The propeller damper includes a first damper and a second damper that are located side by side along the axial direction between the first cylinder portion and the second cylinder portion and are separated from each other by a separation portion so as to be individually elastically deformable. The first damper includes a first inner peripheral surface attached to the outer peripheral surface of the first cylinder portion and a first outer peripheral surface including a first groove having a groove width equal to or less than a width of the third projection in the rotation direction and that extends in the axial direction and engages and interlocks with the third projection. The second damper includes a second inner peripheral surface attached to the outer peripheral surface of the first cylinder portion and a second outer peripheral surface including a second groove having a groove width wider than a width of the fourth projection in the rotation direction and that extends in the axial direction and engages and interlocks with the fourth projection. The separation portion separates the first outer peripheral surface and the second outer peripheral surface from each other.

With this structural arrangement, the propeller damper between the first cylinder portion of the bushing and the second cylinder portion of the propeller body is elastically deformed when a torque that allows the propeller body and the bushing to relatively rotate is generated in a state in which the propeller body is in the non-contact position. When the propeller damper is elastically deformed until the first projection of the first cylinder portion and the second projection of the second cylinder portion come into contact with each other, the propeller body is located at the contact position and the propeller body and the bushing rotate together.

The propeller damper includes the first and second dampers. The first inner peripheral surface of the first damper and the second inner peripheral surface of the second damper are each attached to the outer peripheral surface of the first cylinder portion. The third projection of the second cylinder portion is press fitted, for example, into the first groove provided at the first outer peripheral surface of the first damper, whereas the fourth projection of the second cylinder portion has a clearance in the rotation direction and is located at the second groove provided at the second outer peripheral surface of the second damper. Therefore, until the propeller body is located at the contact position when a torque is generated, the first damper is elastically deformed first, and then the second damper is elastically deformed thereafter by causing the fourth projection to come into contact with the side surface of the second groove. Thus, the propeller damper is able to be elastically deformed in a stepwise manner. Therefore, for example, the elastic deformation in the first stage by the first damper is primarily used to prevent the rattling noise, and the elastic deformation of the first damper and the elastic deformation of the second damper in the second stage subsequent to the first stage are primarily used to prevent shift shock.

Particularly, the first and second dampers are separated from each other by the separation portion at least in the first and second outer peripheral surfaces, and are individually elastically deformable. Therefore, when the first damper is elastically deformed in the first stage, the second damper is never elastically deformed together with the first damper, and it is possible to start the elastic deformation of the second damper at the second stage. Therefore, it is possible to emphasize the function of the second damper (for example, shift-shock prevention) in the second stage.

As a consequence of these capabilities, both the prevention of the rattling noise and shift shock are achieved in the propeller.

The propeller damper of Japanese Unexamined Patent Publication No. 2015-217893 is an integrally-molded piece formed by molding the first and second dampers integrally with each other as described above. Therefore, when the first damper is elastically deformed, its deformation is transmitted to the second damper. In other words, the first damper and the second damper are not separated from each other so that these dampers can be elastically deformed individually. The propeller damper of a preferred embodiment of the present invention includes the first and second dampers separated from each other by the separation portion and are individually elastically deformed, such that the propeller damper differs in structure from the propeller damper of Japanese Unexamined Patent Publication No. 2015-217893.

In a preferred embodiment of the present invention, the separation portion completely separates the first damper and the second damper from each other by extending through the propeller damper along the radial direction.

This structural arrangement makes it possible to further prevent the second damper from being elastically deformed at the same time when the first damper is elastically deformed in the first stage, and makes it possible to reliably start the elastic deformation of the second damper at the second stage. Therefore, the second damper is able to further emphasize its function (for example, shift-shock prevention) in the second stage. Therefore, both prevention of the rattling noise and shift shock are achieved in the propeller.

In a preferred embodiment of the present invention, the first cylinder portion is completely divided into a first divided cylinder portion to which the first inner peripheral surface is attached and a second divided cylinder portion to which the second inner peripheral surface is attached. A relative position between the first divided cylinder portion and the second divided cylinder portion in the rotation direction is changeable.

This structural arrangement makes it possible to adjust the position of the fourth projection of the propeller body in the second groove of the second damper by allowing an operator to change the relative position in the rotation direction between the first and second divided cylinder portions. This enables the operator to adjust a timing at which torque is generated and at which the fourth projection comes into contact with the side surface of the second groove, i.e., the timing at which the second damper starts elastic deformation.

In a preferred embodiment of the present invention, the first inner peripheral surface and the second inner peripheral surface are cure adhered to the outer peripheral surface of the first cylinder portion.

In a preferred embodiment of the present invention, the first damper and the second damper may each have a cylindrical shape that surrounds the bushing.

In a preferred embodiment of the present invention, the second damper is harder than the first damper.

This structural arrangement makes it possible to primarily use the elastic deformation of the second damper in the second stage to prevent shift shock that may be caused in a situation in which a torque is larger than when a rattling noise occurs if the elastic deformation of the first damper in the first stage is primarily used to prevent the rattling noise.

In a preferred embodiment of the present invention, a groove width of the second groove is wider than a groove width of the first groove.

This structural arrangement makes it possible to press fit the third projection into the first groove while locating the fourth projection in the second groove with a clearance in the rotation direction if the width of the third projection that engages and interlocks with the first groove and the width of the fourth projection that engages and interlocks with the second groove are equal or substantially equal to each other.

In a preferred embodiment of the present invention, the propeller body may include an inner cylinder that includes the second cylinder portion and an outer cylinder that includes the plurality of blades and surrounds the inner cylinder.

In a preferred embodiment of the present invention, the third projection and the fourth projection may be unitary with each other.

A preferred embodiment of the present invention provides a vessel propulsion apparatus including the propeller. The vessel propulsion apparatus includes a propeller shaft that rotates together with the propeller, an engine, a drive shaft that is rotated by power of the engine, and a transmission that transmits rotation of the drive shaft to the propeller shaft. The transmission includes a rotary body that rotates interlockingly with the rotation of the drive shaft and a dog clutch that is movable between a connection position at which the dog clutch engages with the rotary body and a disconnection position at which the dog clutch is spaced away from the rotary body and rotates interlockingly with the propeller shaft.

With this structural arrangement, in a state in which the dog clutch that rotates interlockingly with the propeller shaft is located at the disconnection position and is spaced away from the rotary body, the rotary body that rotates interlockingly with the rotation of the drive shaft runs idle, and therefore the rotation of the drive shaft is not transmitted to the propeller shaft. The shift position of the vessel propulsion apparatus at this time is hereinafter referred to as "neutral." When the dog clutch moves from the disconnection position to the connection position and engages with the rotary body, the vessel propulsion apparatus is shifted in. Thereupon, the rotation of the drive shaft is transmitted to the propeller shaft through the rotary body and the dog clutch and, as a result, the propeller shaft rotates together with the propeller, and therefore the propeller generates a thrust.

In the propeller on which a torque generated by the rotation transmitted from the drive shaft to the propeller shaft acts, the first damper is elastically deformed first, and then the second damper is elastically deformed thereafter as described above until the propeller body is located at the contact position. Therefore, for example, it is possible to primarily use the elastic deformation of the first damper in the first stage to prevent a rattling noise after being shifted in, and it is possible to primarily use the elastic deformation of the second damper in the second stage to prevent a shift shock caused when shifted in. Therefore, in the vessel propulsion apparatus, both the prevention of the rattling noise and the shift shock are achieved.

In a preferred embodiment of the present invention, the rotary body includes a first rotary body and a second rotary body that are located side by side in the axial direction and that rotate in mutually opposite directions around a rotational axis of the propeller shaft. The dog clutch is movable along the axial direction. The connection position includes a first connection position at which the dog clutch engages only with the first rotary body and a second connection position at which the dog clutch engages only with the second rotary body.

With this structural arrangement, when the dog clutch moves from the disconnection position to the first connection position and engages with the first rotary body, the outboard motor whose shift position is "neutral" is shifted in, for example, "forward movement." Thereupon, the rotation of the drive shaft is transmitted to the propeller shaft through the rotary body and the dog clutch and, as a result, the propeller shaft rotates together with the propeller, and therefore the propeller generates a forward thrust. On the other hand, when the dog clutch moves from the disconnection position to the second connection position and engages with the second rotary body, the outboard motor that is in a neutral state is shifted in "backward movement." Thereupon, the rotation of the drive shaft is transmitted to the propeller shaft through the rotary body and the dog clutch and, as a result, the propeller shaft rotates together with the propeller, and therefore the propeller generates a backward thrust.

In the propeller that has received a torque generated by the rotation transmitted from the drive shaft to the propeller shaft, the first damper is elastically deformed first, and then the second damper is elastically deformed thereafter until the propeller body is located at the contact position. Therefore, for example, it is possible to primarily use the elastic deformation of the first damper in the first stage to prevent a rattling noise after being shifted in, and primarily use the elastic deformation of the second damper in the second stage to prevent a shift shock caused when shifted in. Therefore, in the vessel propulsion apparatus, both prevention of a rattling noise and shift shock are achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
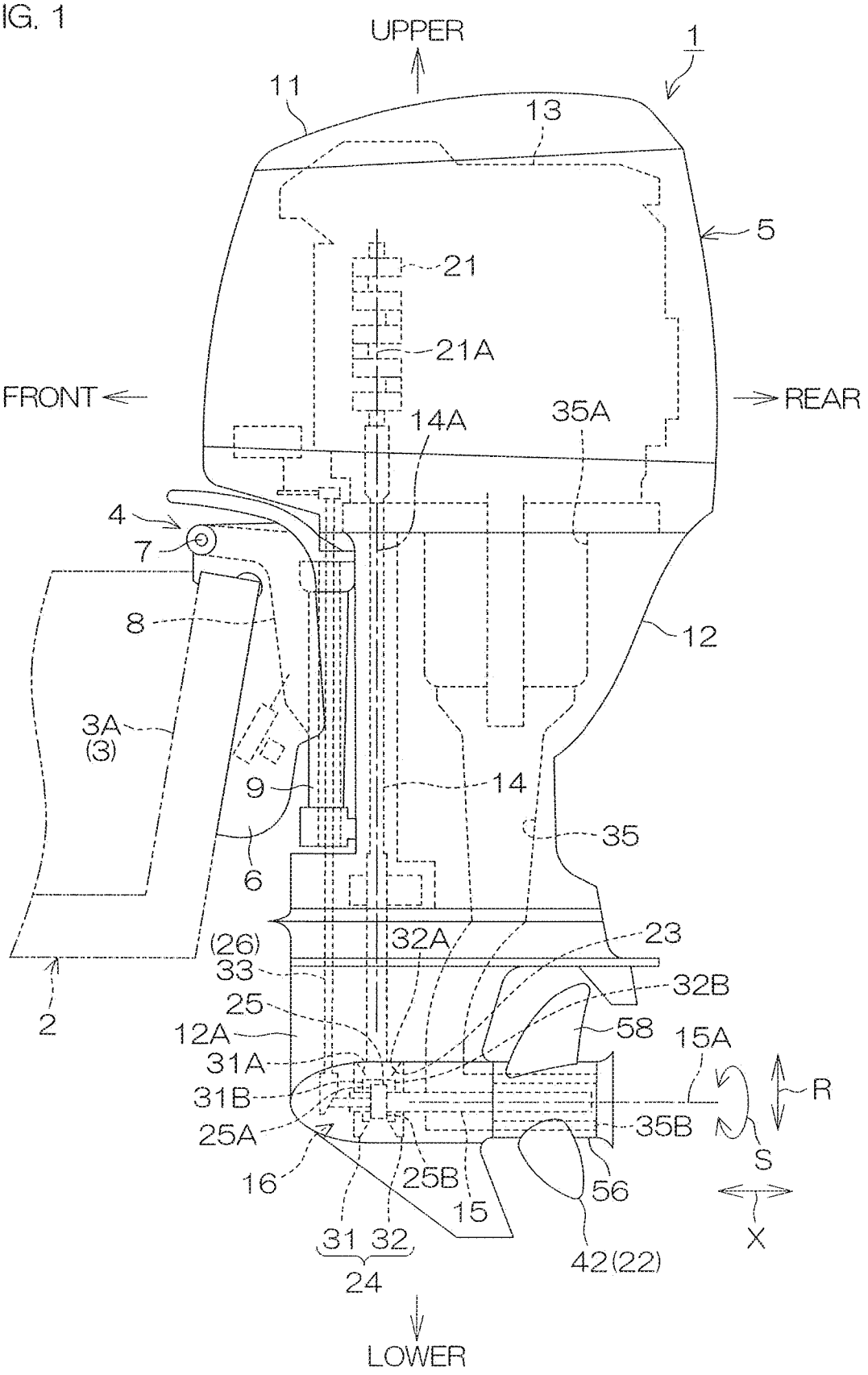
FIG. 1 is a schematic side view of a vessel propulsion apparatus according to a preferred embodiment of the present invention.

FIG. 1 is a schematic left side view of a vessel propulsion apparatus 1 according to a preferred embodiment of the present invention. A left side in FIG. 1 is a front side of the vessel propulsion apparatus 1, and a right side in FIG. 1 is a rear side of the vessel propulsion apparatus 1. A near side in a direction perpendicular to a plane of paper of FIG. 1 is a left side of the vessel propulsion apparatus 1, and a far side in the direction perpendicular to the plane of paper of FIG. 1 is a right side of the vessel propulsion apparatus 1.

The vessel propulsion apparatus 1 includes an attachment 4 to which a transom 3A of a hull 3 of a vessel 2 is attached and an outboard motor 5. The attachment 4 includes a clamp bracket 6 fixed to the transom 3A and a swivel bracket 8 coupled to the clamp bracket 6 through a tilt shaft 7 extending in a left-right direction along the horizon. The swivel bracket 8 is coupled to the outboard motor 5 through a steering shaft 9 extending in an up-down direction. Thus, the outboard motor 5 is attached to the transom 3A by the attachment 4 in a substantially vertical attitude.

The outboard motor 5 and the swivel bracket 8 are turnable in the up-down direction around the tilt shaft 7 with respect to the clamp bracket 6. The outboard motor 5 is turned around the tilt shaft 7, and, as a result, the outboard motor 5 is tilted with respect to the hull 3 and the clamp bracket 6. The outboard motor 5 is turnable in the left-right direction together with the steering shaft 9 with respect to the clamp bracket 6 and the swivel bracket 8. When the outboard motor 5 is turned in the left-right direction, the vessel 2 is steered.

The outboard motor 5 includes a box-shaped engine cover 11 and a hollow casing 12 extending downwardly from the engine cover 11. A lower end portion of the casing 12 is a lower case 12A. The outboard motor 5 includes an engine 13 housed in the engine cover 11, a drive shaft 14 that extends downwardly from the engine 13 and most of which is located in the casing 12, and a propeller shaft 15 and a transmission 16 that are located in the lower case 12A.

The engine 13 is an internal combustion engine that generates power by burning fuel, such as gasoline, and contains a piston (not shown) and a crank shaft 21 coupled to the piston. The crank shaft 21 has a crankshaft axis 21A extending in the up-down direction.

A lower end portion of the crank shaft 21 is coupled to an upper end portion of the drive shaft 14. The drive shaft 14 extends along the up-down direction between the propeller shaft 15 and the engine 13. When the piston rectilinearly reciprocates in the front-rear direction perpendicular to the crankshaft axis 21A, the crank shaft 21 is driven and rotated around the crankshaft axis 21A while being accompanied by the drive shaft 14. In other words, the drive shaft 14 is rotated by the power of the engine 13. A rotational axis 14A of the drive shaft 14 coincides with the crankshaft axis 21A when seen from above.

The propeller shaft 15 extends in the front-rear direction in the lower case 12A. Therefore, an axial direction X of the propeller shaft 15 is the front-rear direction. A lower end portion of the drive shaft 14 is coupled to a front end portion of the propeller shaft 15 by the transmission 16. A rear end portion of the propeller shaft 15 protrudes rearwardly from the lower case 12A. The vessel propulsion apparatus 1 includes a propeller 22 attached to the rear end portion of the propeller shaft 15. The propeller shaft 15 rotates together with the propeller 22 around a rotational axis 15A that extends in the front-rear direction. Likewise, an axial direction of the propeller 22 is the axial direction X. Although the propeller 22 rotates together with the propeller shaft 15 in a preferred embodiment of the present invention, the propeller 22 may rotate in a direction opposite to that of the propeller shaft 15 by interposing a relay gear (not shown) between the propeller 22 and the propeller shaft 15.

The transmission 16 is used to transmit the rotation of the drive shaft 14 to the propeller shaft 15. The transmission 16 includes a driving gear 23 fixed to the lower end portion of the drive shaft 14, a rotary body 24 and a dog clutch 25 that are attached to the front end portion of the propeller shaft 15, and a shifter 26 located at a more forward position than the propeller shaft 15 in the lower case 12A. The driving gear 23 is a bevel gear. The propeller shaft 15 is located below the driving gear 23. The rotary body 24 includes a first rotary body 31 and a second rotary body 32 that are located side by side in the front-rear direction along the propeller shaft 15. The first and second rotary bodies 31 and 32 are, for example, cylindrical bevel gears, respectively. Although the term "cylindrical" in this description is, strictly speaking, "circularly cylindrical," it may be "angularly cylindrical" in some situations.

In a preferred embodiment of the present invention, the first rotary body 31 is located at a more forward position than the driving gear 23, and the second rotary body 32 is located at a more rearward position than the driving gear 23, and yet a front-rear positional relationship between the first and second rotary bodies 31 and 32 may be opposite to that of the present preferred embodiment. In a rear surface of the first rotary body 31, a tooth portion 31A is provided at a tapered outer peripheral portion, and a claw portion 31B is provided at an inner peripheral portion. In a front surface of the second rotary body 32, a tooth portion 32A is provided at a tapered outer peripheral portion, and a claw portion 32B is provided at an inner peripheral portion.

The first rotary body 31 surrounds a portion, which is at a more forward position than the driving gear 23, of the front end portion of the propeller shaft 15, and the second rotary body 32 surrounds a portion, which is at a more rearward position than the driving gear 23, of the front end portion of the propeller shaft 15. The first and second rotary bodies 31 and 32 are located so that their tooth portions 31A and 32A face each other with an interval between the tooth portions 31A and 32A in the front-rear direction, and engage with the driving gear 23. When the driving gear 23 rotates together with the drive shaft 14 in response to the driving of the engine 13, the rotation of the driving gear 23 is transmitted to the first and second rotary bodies 31 and 32. Thereupon, the first and second rotary bodies 31 and 32 rotate interlockingly with the rotation of the drive shaft 14. At this time, the first and second rotary bodies 31 and 32 rotate in mutually opposite directions around the rotational axis 15A of the propeller shaft 15.

The dog clutch 25 is located between the first and second rotary bodies 31 and 32. The dog clutch 25 is, for example, cylindrical, and surrounds the front end portion of the propeller shaft 15. A first claw portion 25A is provided at a front end surface of the dog clutch 25, and a second claw portion 25B is provided at a rear end surface of the dog clutch 25. The dog clutch 25 is coupled to the front end portion of the propeller shaft 15 by, for example, a spline. Therefore, the dog clutch 25 rotates together with the front end portion of the propeller shaft 15. In other words, the dog clutch 25 rotates interlockingly with the propeller shaft 15. Additionally, the dog clutch 25 is movable in the front-rear direction with respect to the front end portion of the propeller shaft 15. In other words, the dog clutch 25 is rotatable together with the propeller shaft 15, and is relatively movable along the front-rear direction with respect to the propeller shaft 15.

The shifter 26 includes, for example, a shift rod 33 extending in the up-down direction and an operation cable (not shown) joined to the shift rod 33. A lower end portion of the shift rod 33 is coupled to the dog clutch 25. The shift rod 33 turns around an axis of the shift rod 33 by an operating force input from the operation cable. The dog clutch 25 is moved along the front-rear direction between a disconnection position and a connection position by turning the shift rod 33.

As shown in FIG. 1, the disconnection position is a position at which the dog clutch 25 is spaced away from the first and second rotary bodies 31 and 32 and engages with neither of the rotary bodies 24. In a state in which the dog clutch 25 is located at the disconnection position, each of the rotary bodies 24 to which the rotation of the drive shaft 14 is transmitted runs idle, and therefore the rotation of the drive shaft 14 is not transmitted to the propeller shaft 15. The shift position of the outboard motor 5 at this time is hereinafter referred to as "neutral."

The connection position is a position at which the dog clutch 25 engages with either one of the first and second rotary bodies 31 and 32. The connection position includes a first connection position at which the first claw portion 25A of the dog clutch 25 engages with only the claw portion 31B of the first rotary body 31 and a second connection position at which the second claw portion 25B of the dog clutch 25 engages with only the claw portion 32B of the second rotary body 32. The disconnection position is a position between the first connection position and the second connection position. The first connection position is more forward than the disconnection position, and the second connection position is more rearward than the disconnection position.

In a state in which the dog clutch 25 is located at the first connection position and is coupled only to the first rotary body 31, the rotation of the first rotary body 31 is transmitted to the propeller shaft 15, and therefore the shift position of the outboard motor 5 is shifted in "forward movement." Thereupon, the rotation of the drive shaft 14 is transmitted to the propeller shaft 15 through the first rotary body 31 and the dog clutch 25, and therefore the propeller 22 rotates in a forward rotational direction (for example, clockwise when seen from the rear). Thus, the propeller 22 generates a forward thrust.

In a state in which the dog clutch 25 is located at the second connection position and is coupled only to the second rotary body 32, the rotation of the second rotary body 32 is transmitted to the propeller shaft 15, and therefore the shift position of the outboard motor 5 is shifted in "backward movement." Thereupon, the rotation of the drive shaft 14 is transmitted to the propeller shaft 15 through the second rotary body 32 and the dog clutch 25, and therefore the propeller 22 rotates in a backward rotational direction opposite to the forward rotational direction. Thus, the propeller 22 generates a backward thrust. As thus described, in a preferred embodiment of the present invention, the first rotary body 31 is a gear for forward movement, whereas the second rotary body 32 is a gear for backward movement. Of course, the first rotary body 31 may be a gear for backward movement, and the second rotary body 32 may be a gear for forward movement.

The outboard motor 5 includes an exhaust passage 35 provided inside the outboard motor 5, and the exhaust passage 35 includes an inlet 35A connected to the engine 13 and an outlet 35B provided at the propeller 22. In a state in which the vessel 2 is floating on water and in which the propeller 22 is positioned below a water surface, the outlet 35B is positioned in water, and therefore water that has passed through the outlet 35B enters a downstream portion of the exhaust passage 35. On the other hand, when the engine 13 rotates at a high speed, water in the exhaust passage 35 is pushed by the pressure of exhaust gases from the engine 13, and is discharged from the outlet 35B together with the exhaust gases. Thus, the exhaust gases generated in the engine 13 are discharged into water.

Figure 2:
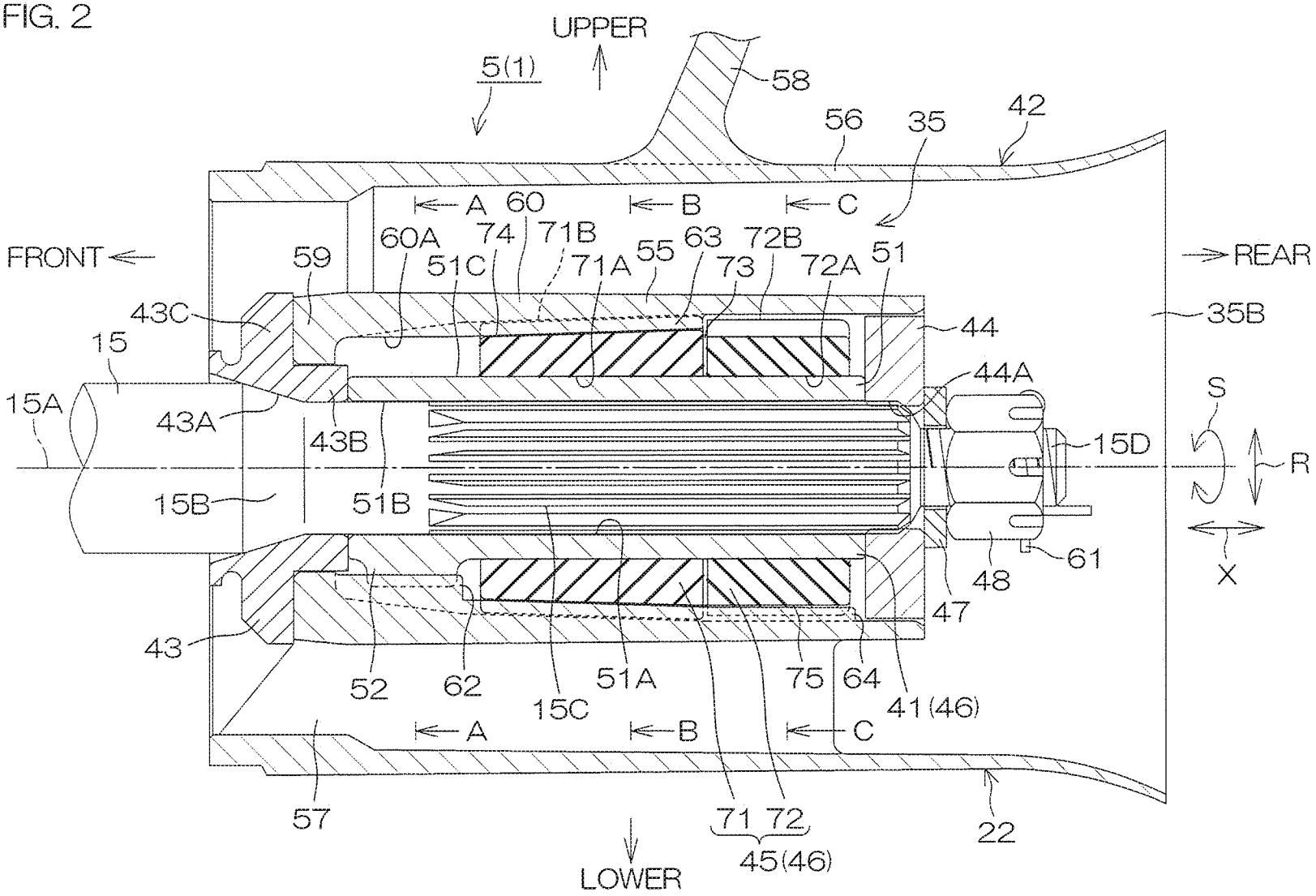
FIG. 2 is a longitudinal sectional view of a lower portion of the vessel propulsion apparatus.

Next, the propeller 22 will be described in detail. FIG. 2 is a longitudinal sectional view of the propeller 22 and its surroundings in the outboard motor 5. The propeller 22 includes a cylindrical bushing 41 fixed to the propeller shaft 15 and a cylindrical propeller body 42 surrounding the bushing 41. The propeller 22 additionally includes an annular front spacer 43 located in front of both the bushing 41 and the propeller body 42 and a disk-shaped rear spacer 44 located behind a damper unit 46. The propeller 22 additionally includes a cylindrical propeller damper 45 located between the bushing 41 and the propeller body 42. The bushing 41 and the propeller damper 45 are elements of the cylindrical damper unit 46. The rear end portion of the propeller shaft 15 includes a taper portion 15B to which the front spacer 43 is attached, a spline shaft portion 15C spline-connected to the bushing 41 and to the rear spacer 44, and a male screw portion 15D to which a washer 47 and a nut 48 are attached.

The bushing 41 is metallic. The bushing 41 includes a first cylinder portion 51 extending in the axial direction X. The first cylinder portion 51 includes a spline hole 51A that extends forwardly from a rear end of the first cylinder portion 51, an inner peripheral surface 51B extending forwardly from the spline hole 51A, and a circularly-cylindrical outer peripheral surface 51C extending in the axial direction X, and the first cylinder portion 51 coaxially surrounds the rear end portion of the propeller shaft 15. A plurality of teeth provided at the spline shaft portion 15C of the propeller shaft 15 are meshed with a plurality of teeth provided at the spline hole 51A of the first cylinder portion 51. Thus, the bushing 41 rotates together with the propeller shaft 15. Both of the inner peripheral surface 51B and the outer peripheral surface 51C are circularly-cylindrical surfaces the outer diameter of each of which is fixed.

A radial direction based on the rotational axis 15A of the propeller shaft 15 is hereinafter referred to as a "radial direction R." The radial direction R is also a radial direction of the propeller 22. A direction approaching the rotational axis 15A is inward in the radial direction R, whereas a direction away from the rotational axis 15A is outward in the radial direction R. Additionally, a circumferential direction around the rotational axis 15A is a rotation direction S of the propeller 22.

The bushing 41 includes a plurality of (for example, three) first projections 52 that protrude outwardly in the radial direction R from a front end portion of the outer peripheral surface 51C of the first cylinder portion 51. For example, the three first projections 52 are equally or substantially equally spaced apart in the rotation direction S. The first projection 52 is integral with the first cylinder portion 51. A front end of the first projection 52 is located at a more rearward position than a front end of the first cylinder portion 51.

Figure 6:
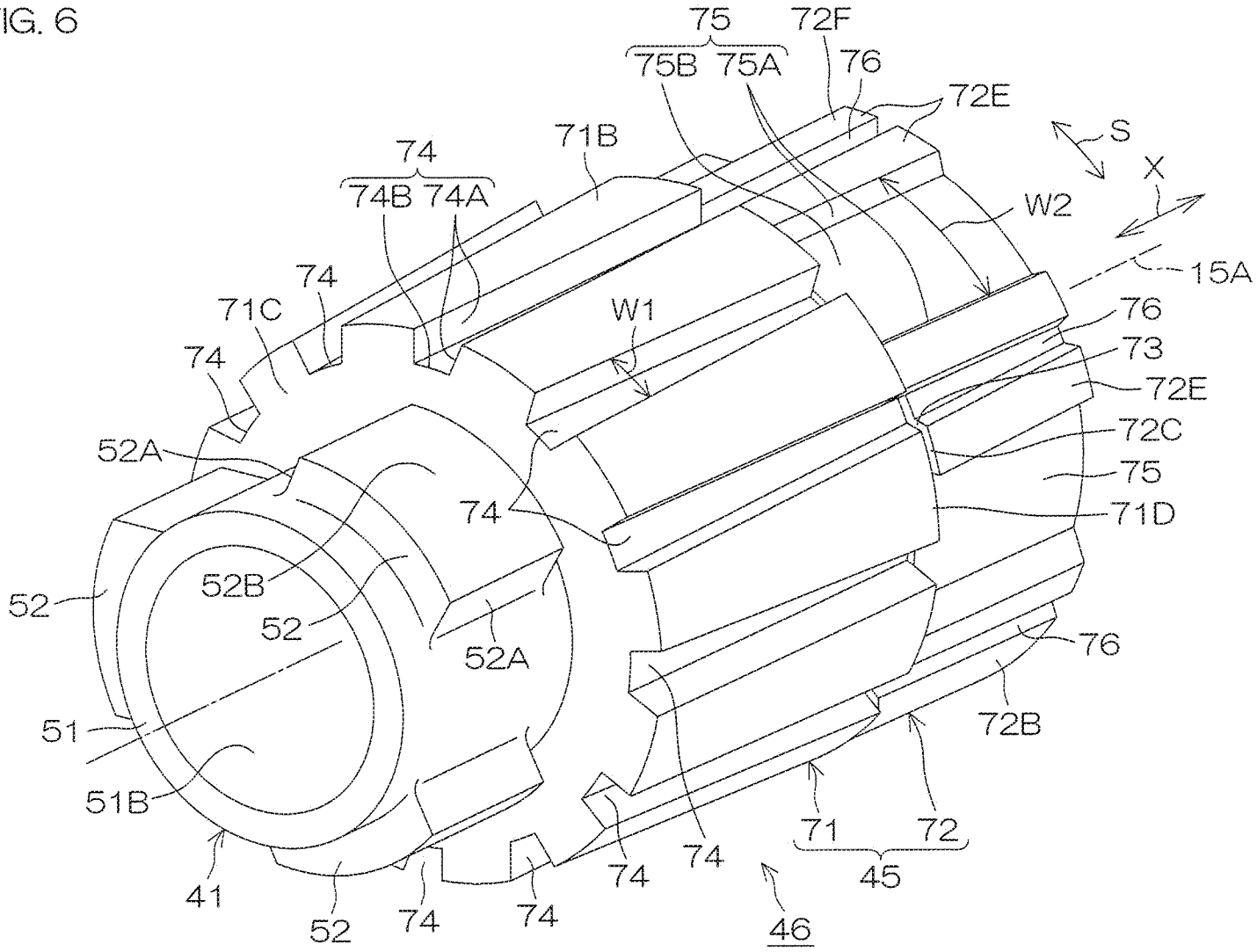
FIG. 6 is a perspective view of a damper unit included in the propeller.

An outer surface of each of the first projections 52 includes a pair of side surfaces 52A extending in the axial direction X and in the radial direction R and a forward end surface 52B that couples outer ends in the radial direction R of the pair of side surfaces 52A together (see FIG. 6). The forward end surface 52B has a circular arc shape that is coaxial with the outer peripheral surface 51C of the first cylinder portion 51. The height of the first projection 52 in the radial direction R is equal at any position in the axial direction X. The height of the first projection 52 is larger than the thickness of the first cylinder portion 51, i.e., is larger than the distance in the radial direction R from the inner peripheral surface 51B of the first cylinder portion 51 to the outer peripheral surface 51C of the first cylinder portion 51. The width of the forward end surface 52B in the rotation direction S is equal at any position in the axial direction X.

The propeller body 42 includes an inner cylinder 55 that extends in the axial direction X and that coaxially surrounds the bushing 41, an outer cylinder 56 that coaxially surrounds the inner cylinder 55 at a distance from the inner cylinder 55 in the radial direction R, and a plurality of (for example, three) ribs 57 that connect an outer peripheral surface of the inner cylinder 55 and an inner peripheral surface of the outer cylinder 56 together. The inner cylinder 55, the outer cylinder 56, and the rib 57 are integral with each other, and are, for example, metallic. The outer cylinder 56 includes a plurality of blades 58 that extend outwardly from its outer peripheral surface in the radial direction R. The blades 58 are integral with the outer peripheral surface of the outer cylinder 56, and are arranged at equal or substantially equal intervals along the rotation direction S. In the propeller 22 that is rotating, the blades 58 generate a forward thrust or a backward thrust. A space between the outer peripheral surface of the inner cylinder 55 and the inner peripheral surface of the outer cylinder 56 defines a portion of the exhaust passage 35 described above. An opening fringed by a rear end of the outer cylinder 56 defines an outlet 35B of the exhaust passage 35.

The inner cylinder 55 includes an annular flange portion 59 surrounding the propeller shaft 15 and a second cylinder portion 60 that extends rearwardly from the outer peripheral portion of the flange portion 59 and that surrounds the bushing 41. The damper unit 46 including the bushing 41 is located in the second cylinder portion 60. The inner diameter of the flange portion 59 is smaller than the outer diameter of the damper unit 46. The inner diameter of a rear end of the second cylinder portion 60 is larger than the outer diameter of the damper unit 46. The blades 58 are each located at a more outward position than the second cylinder portion 60 with respect to the radial direction R. The second cylinder portion 60 is described in detail below.

The front spacer 43 includes a tapered inner peripheral surface 43A along an outer peripheral surface of the taper portion 15B of the propeller shaft 15, a cylindrical fit portion 43B fitted in the flange portion 59 of the inner cylinder 55, and an annular support portion 43C located in front of the flange portion 59 of the inner cylinder 55. The fit portion 43B is located in front of the bushing 41. A front end surface of the bushing 41 is pressed against a rear end surface of the fit portion 43B. An outer peripheral surface of the fit portion 43B is surrounded by the flange portion 59 of the inner cylinder 55. The support portion 43C is a circular ring disposed coaxially with the fit portion 43B, and has an outer diameter larger than the fit portion 43B. A rear end surface of the support portion 43C comes into contact with a front end surface of the flange portion 59 of the inner cylinder 55, and supports the inner cylinder 55 from the front.

The rear spacer 44 is spline-coupled to the spline shaft portion 15C of the propeller shaft 15. Rear end portions of a plurality of teeth provided at the spline shaft portion 15C mesh with a plurality of teeth provided at the spline hole 44A of the rear spacer 44. An outer peripheral surface of the rear spacer 44 is a circularly cylindrical surface whose outer diameter is fixed, and is surrounded by a rear end portion of the second cylinder portion 60 of the inner cylinder 55. The outer diameter of the rear spacer 44 is smaller than the inner diameter of the second cylinder portion 60, and is larger than the inner diameter of the flange portion 59 of the inner cylinder 55. A front end surface of the rear spacer 44 is pressed against a rear end surface of the bushing 41, and faces a rear end surface of the propeller damper 45 from the rear with an interval between the front end surface of the rear spacer 44 and the rear end surface of the propeller damper 45. The bushing 41 is spline-coupled to the spline shaft portion 15C of the propeller shaft 15, and is sandwiched between the front spacer 43 and the rear spacer 44 from the front-rear direction, and is positioned with respect to the propeller shaft 15 in the front-rear direction and in the rotation direction S.

The washer 47 is pressed against a rear end surface of the rear spacer 44. The nut 48 incorporated into the spline shaft portion 15C forwardly presses the washer 47, and therefore the rear spacer 44 is fixed so as not to come off rearwardly from the spline shaft portion 15C of the propeller shaft 15. A pin 61 is inserted in a through-hole (not shown) that extends through the nut 48 and through the propeller shaft 15 in the radial direction R, and therefore loosening of the nut 48 is regulated.

Figure 3:
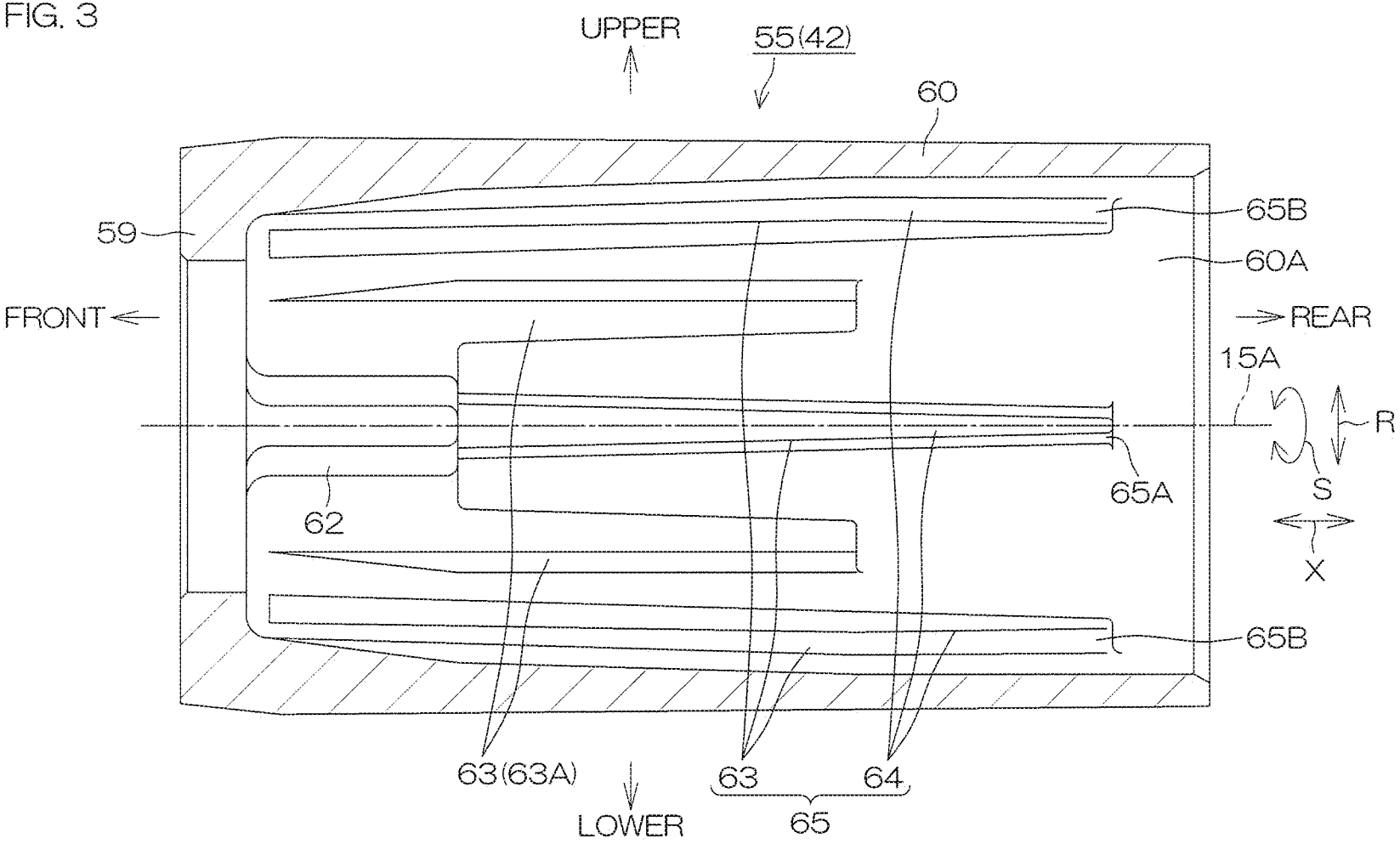
FIG. 3 is a longitudinal sectional view of an inner cylinder of a propeller included in the vessel propulsion apparatus.

Next, the second cylinder portion 60 of the inner cylinder 55 will be described in detail. FIG. 3 is a longitudinal sectional view in which only the inner cylinder 55 has been extracted from FIG. 2. The inner cylinder 55 additionally includes a plurality of second projections 62, a plurality of third projections 63, and a plurality of fourth projections 64 each of which protrudes inwardly in the radial direction R from an inner peripheral surface 60A of the second cylinder portion 60 and each of which extends in the front-rear direction.

For example, three second projections 62 are provided, and are arranged at equal or substantially equal intervals between the second projections 62 in the rotation direction S in a front end portion of the inner peripheral surface 60A. The second projection 62 is shorter than the third and fourth projections 63 and 64 in the front-rear direction. A front end portion of each of the second projections 62 is connected to the flange portion 59 of the inner cylinder 55.

For example, twelve third projections 63 are provided, and are arranged at equal or substantially equal intervals between third projections 63 in the rotation direction S in a region of substantially the front half of the inner peripheral surface 60A. The third projection 63 is deviated from the second projection 62 with respect to at least either one of the rotation direction S and the front-rear direction. In other words, the third projection 63 is provided at a position different from that of the second projection 62 in the inner peripheral surface 60A.

For example, six fourth projections 64 are provided, and are arranged at equal or substantially equal intervals in the rotation direction S in a region closer to the rear in the inner peripheral surface 60A. Therefore, the fourth projection 64 is located at a more rearward position than the second projection 62 and the third projection 63. In other words, the fourth projection 64 is located at a position different from that of the second projection 62 and that of the third projection 63 with respect to the front-rear direction (axial direction X). Each of the fourth projections 64 is located at the same position as any one of the third projections 63 one by one in the rotation direction S, and extends rearwardly from a rear end of a corresponding one of the third projections 63. The third projection 63 and the fourth projection 64, which are located at the same position in the rotation direction S and which are continuous in the front-rear direction, are unitary and define a single engagement projection 65. Six engagement projections 65 are provided, and are arranged at equal or substantially equal intervals between the engagement projection 65 in the rotation direction S.

Figure 4:
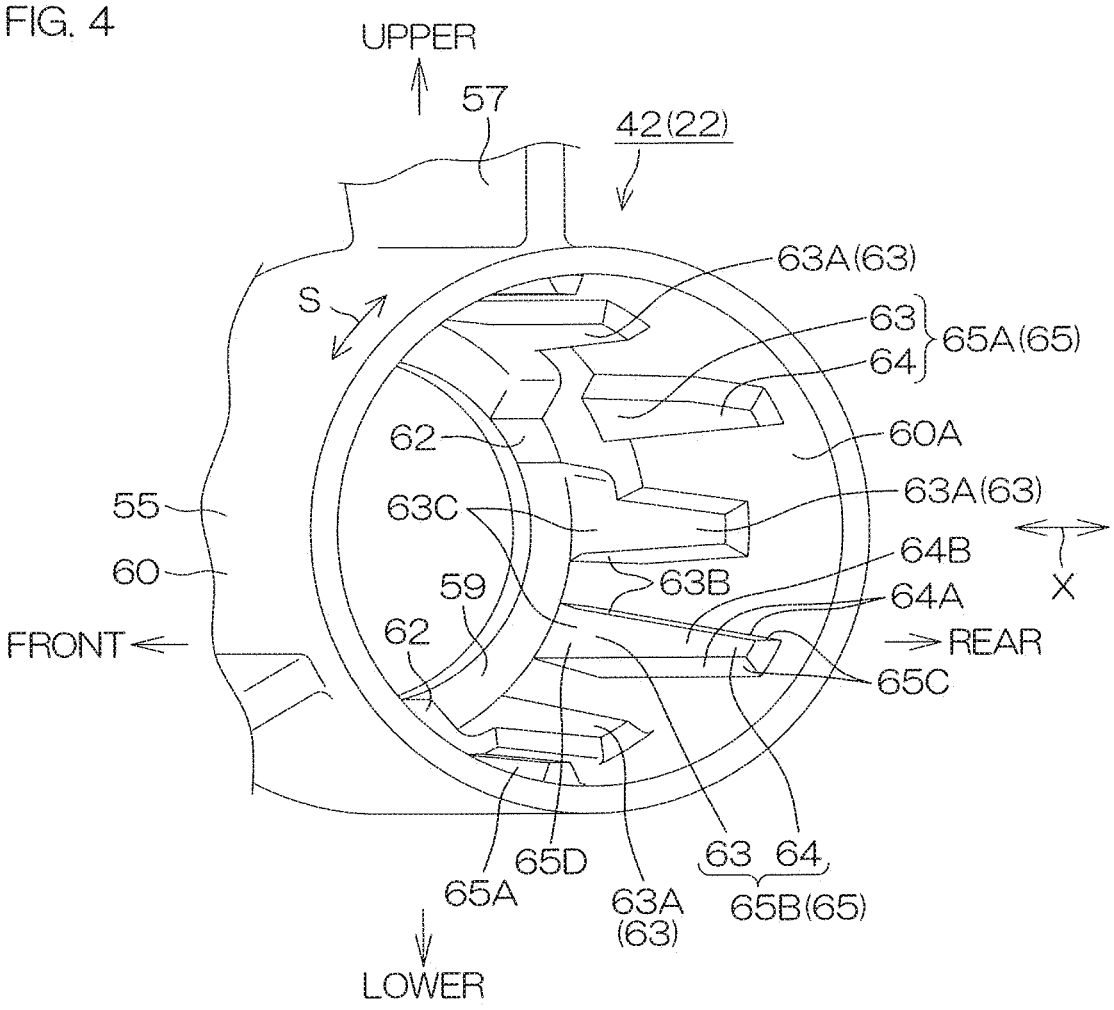
FIG. 4 is a perspective view of the inner cylinder as seen from the rear.
Figure 5:
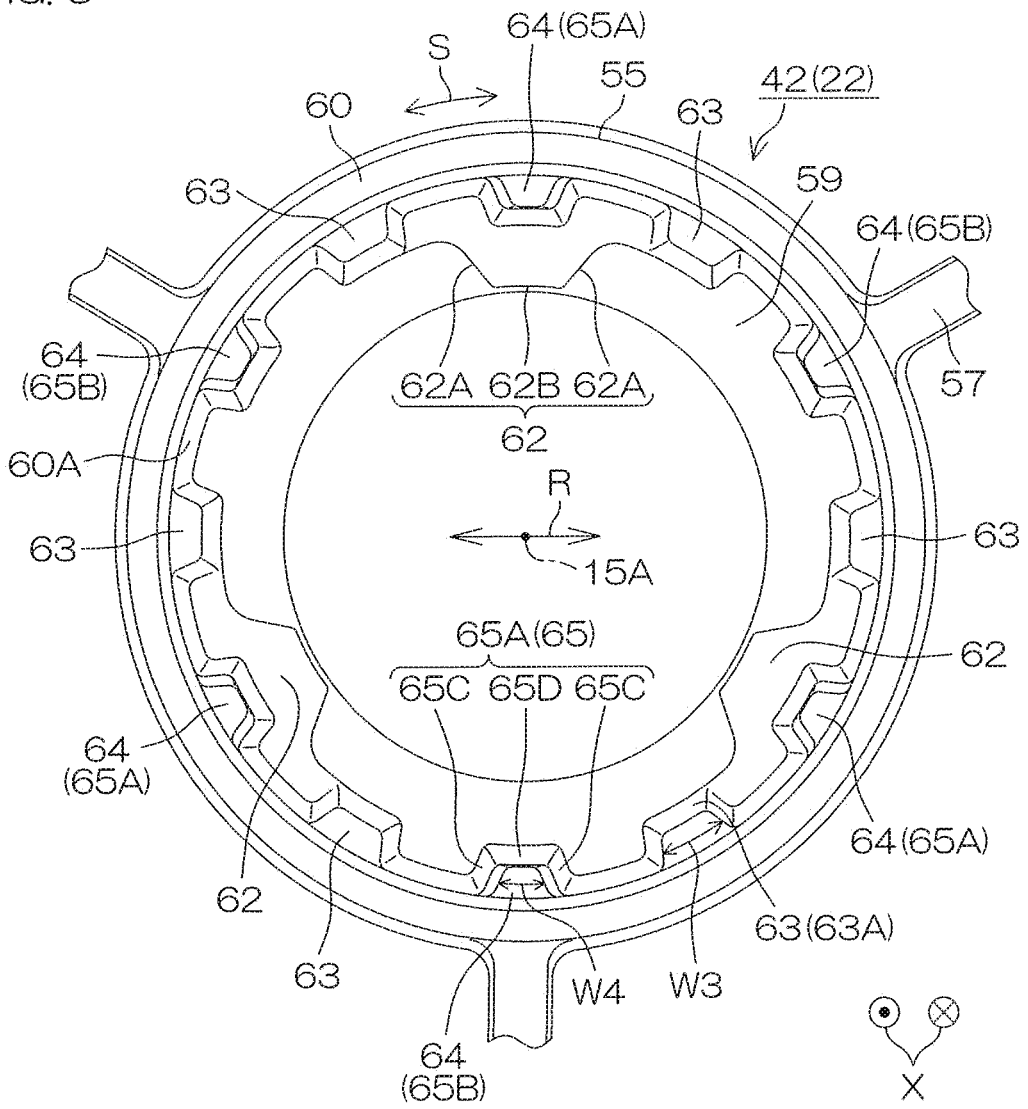
FIG. 5 is a rear view of the inner cylinder.

FIG. 4 is a perspective view of the inner cylinder 55 as seen from behind. FIG. 5 is a rear view of the inner cylinder 55. Three engagement projections 65 (hereinafter, referred to as the "first engagement projection 65A") among the six engagement projections 65 are located at the same position as the three second projections 62 one by one in the rotation direction S, and extend rearwardly from rear ends of the corresponding second projections 62, respectively. Therefore, when the inner cylinder 55 is seen from behind, the three first engagement projections 65A overlap with the three second projections 62, respectively. In the second projection 62 and the first engagement projection 65A that overlap with each other, the center of each other is located at the same position in the rotation direction S.

Three engagement projections 65 other than the first engagement projection 65A are referred to as the "second engagement projection 65B." The third projections 63, which are not located at the same position as the second projection 62 and the fourth projection 64 in the rotation direction S, are referred to as the "third engagement projection 63A." A front end portion of the second engagement projection 65B and a front end portion of the third engagement projection 63A are connected to the flange portion 59 of the inner cylinder 55. The first engagement projection 65A, the second engagement projection 65B, and the third engagement projection 63A are arranged at equal or substantially equal intervals between them in the rotation direction S. The first engagement projection 65A or the second engagement projection 65B is located between two third engagement projections 63A adjoining in the rotation direction S.

The height (length in the radial direction R) of the second projection 62 from the inner peripheral surface 60A of the second cylinder portion 60 is larger than that of the first engagement projection 65A, than that of the second engagement projection 65B, and than that of the third engagement projection 63A from the inner peripheral surface 60A. Additionally, the width (length in the rotation direction S) of the second projection 62 is larger than that of the first engagement projection 65A, than that of the second engagement projection 65B, and than that of the third engagement projection 63A. The first engagement projection 65A, the second engagement projection 65B, and the third engagement projection 63A are equal to or substantially equal to each other in height and in width although different from each other in size in the front-rear direction.

An outer surface of the second projection 62 includes a pair of side surfaces 62A extending in the axial direction X and in the radial direction R and a forward end surface 62B that couples inner ends in the radial direction R of the pair of side surfaces 62A together (see FIG. 5). The pair of side surfaces 62A are inclined surfaces the interval between which becomes continuously smaller as they approach the forward end surface 62B. The interval between the pair of side surfaces 62A is the same at any position in the front-rear direction if the position in the radial direction R is the same. The forward end surface 62B is a circular-arc surface that extends parallel or substantially parallel with the inner peripheral surface 60A of the second cylinder portion 60. The height of the second projection 62 is the same at any position in the front-rear direction. The width of the forward end surface 62B of the second projection 62 is the same at any position in the front-rear direction.

An outer surface of each of the engagement projections 65 includes a pair of side surfaces 65C extending in the front-rear direction and in the radial direction R and a forward end surface 65D that couples inner ends of the pair of side surfaces 65C together (see FIG. 5). A front portion in the pair of side surfaces 65C is defined by a pair of side surfaces 63B of the third projection 63, and a rear portion in the pair of side surfaces 65C is defined by a pair of side surfaces 64A of the fourth projection 64 (see FIG. 4). A front portion in the forward end surface 65D is defined by a forward end surface 63C of the third projection 63. A rear portion in the forward end surface 65D is defined by a forward end surface 64B of the fourth projection 64.

The pair of side surfaces 65C are inclined surfaces the interval between which becomes continuously smaller as they approach the forward end surface 65D. The width of the forward end surface 65D in the rotation direction S becomes continuously smaller as it approaches a rear end of the forward end surface 65D. Therefore, the width W4 in the rotation direction S of the fourth projection 64 defining the rear portion of the engagement projection 65 is equal to or less than a width W3 in the rotation direction S of the third projection 63 defining the front portion of the engagement projection 65 (see FIG. 5). The forward end surface 65D is inclined with respect to the rotational axis 15A so as to become more distant from the rotational axis 15A as it approaches the rear end of the forward end surface 65D. Therefore, the height of each of the engagement projections 65 becomes continuously smaller as they extend rearward.

An outer surface of the third engagement projection 63A is also shaped in the same way as the outer surface of the engagement projection 65. The sectional shape of the engagement projection 65 and the sectional shape of the third engagement projection 63A, which are formed when these engagement projections are cut by a cutting plane that perpendicularly intersects the front-rear direction, are mutually identical if the position in the front-rear direction is the same.

FIG. 6 is a perspective view of the damper unit 46. The propeller damper 45 which is an element of the damper unit 46 is made of an elastically deformable elastic material, such as rubber or resin. The propeller damper 45 surrounds the first cylinder portion 51 of the bushing 41. The propeller damper 45 is located at a more rearward position than the first projection 52 of the first cylinder portion 51 and at a more forward position than the rear end of the first cylinder portion 51.

The propeller damper 45 includes a first damper 71 and a second damper 72. The first damper 71 and the second damper 72 are located side by side along the front-rear direction so that the first damper 71 is located in front of the second damper 72. Each of the first and second dampers 71 and 72 has a cylindrical shape (more specifically, a circularly cylindrical shape) surrounding the first cylinder portion 51 of the bushing 41.

Figure 7:
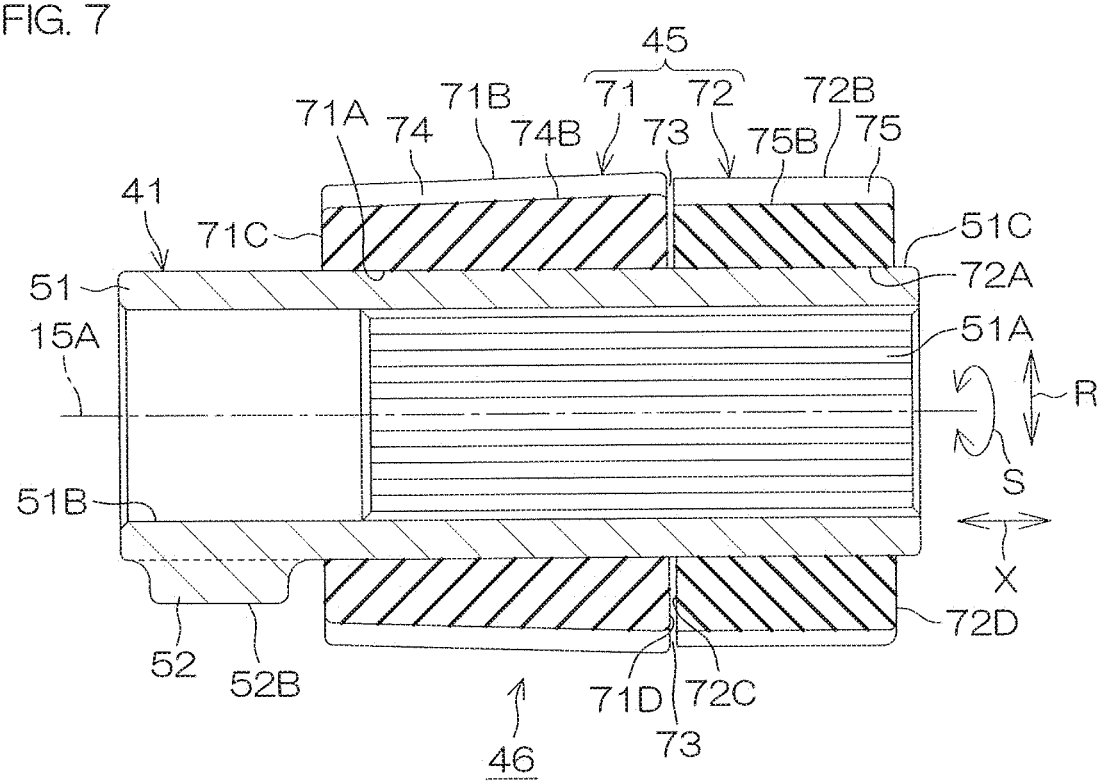
FIG. 7 is a longitudinal sectional view of the damper unit.

FIG. 7 is a longitudinal sectional view of the damper unit 46. The first damper 71 is longer in the front-rear direction than the second damper 72. The first damper 71 has a first inner peripheral surface 71A and a first outer peripheral surface 71B, both of which are cylindrical, and a first front end surface 71C and a first rear end surface 71D, both of which are annular. The second damper 72 has a second inner peripheral surface 72A and a second outer peripheral surface 72B, both of which are cylindrical, and a second front end surface 72C and a second rear end surface 72D, both of which are annular.

The first inner peripheral surface 71A and the second inner peripheral surface 72A are equal to each other in inner diameter. The first and second inner peripheral surfaces 71A and 72A are attached or bonded to the outer peripheral surface 51C of the first cylinder portion 51 of the bushing 41 by, for example, cure adhesion.

The first and second outer peripheral surfaces 71B and 72B are each located at a more outward position in the radial direction R than the forward end surface 52B of the first projection 52 of the bushing 41. The outer diameter of the first outer peripheral surface 71B becomes larger as it approaches a rear end of the first outer peripheral surface 71B. The outer diameter of the second outer peripheral surface 72B is smaller than the outer diameter (overall outer diameter) of the rear end of the first outer peripheral surface 71B, and is the same at any position in the front-rear direction.

The first front end surface 71C is flat along the radial direction R, and connects a front end of the first inner peripheral surface 71A and a front end of the first outer peripheral surface 71B together. The first rear end surface 71D is flat along the radial direction R, and connects a rear end of the first inner peripheral surface 71A and the rear end of the first outer peripheral surface 71B together. The second front end surface 72C is flat along the radial direction R, and connects a front end of the second inner peripheral surface 72A and a front end of the second outer peripheral surface 72B together. The second rear end surface 72D is flat along the radial direction R, and connects a rear end of the second inner peripheral surface 72A and a rear end of the second outer peripheral surface 72B together.

A separation portion 73 that separates at least the first outer peripheral surface 71B of the first damper 71 and the second outer peripheral surface 72B of the second damper 72 from each other is provided at the propeller damper 45. The separation portion 73 is an annular groove that is hollowed inwardly in the radial direction R and encircling the bushing 41 in the rotation direction S. In a preferred embodiment of the present invention, the separation portion 73 completely separates the first and second dampers 71 and 72 from each other by extending through the propeller damper 45 along the radial direction R. The first rear end surface 71D of the first damper 71 and the second front end surface 72C of the second damper 72 face each other with the separation portion 73 between the first rear end surface 71D and the second front end surface 72C. The size (groove width) in the front-rear direction of the separation portion 73 is about several millimeters (mm), for example. The first and second dampers 71 and 72 are individually elastically deformable in a state of being separated from each other by the separation portion 73.

Figure 8:
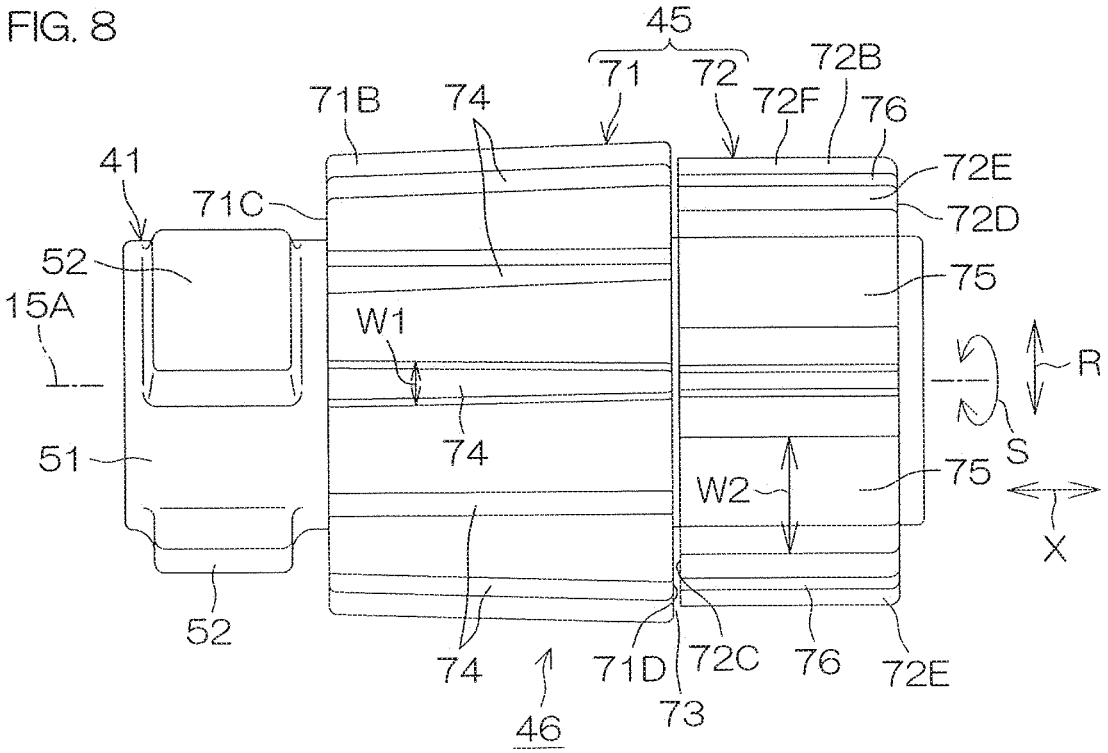
FIG. 8 is a side view of the damper unit.

FIG. 8 is a side view of the damper unit 46. A first groove 74 that extends in the front-rear direction is provided at the first outer peripheral surface 71B of the first damper 71, and a second groove 75 and a third groove 76 that extend in the front-rear direction are provided at the second outer peripheral surface 72B of the second damper 72.

A plurality of first grooves 74 (more specifically, the number of first grooves 74 is equal to the number of third projections 63) are provided, and are arranged at equal or substantially equal intervals between the first grooves 74 along the rotation direction S. A front end and a rear end of the first groove 74 are open at the first front end surface 71C and the first rear end surface 71D of the first damper 71, respectively. An inner surface of the first groove 74 includes a pair of side surfaces 74A extending in the front-rear direction and in the radial direction R and a bottom surface 74B that couples together inner ends in the radial direction R of the pair of side surfaces 74A (see also FIG. 6). The pair of side surfaces 74A extend inwardly in the radial direction R from the first outer peripheral surface 71B of the first damper 71. The pair of side surfaces 74A are inclined surfaces the interval between which becomes continuously smaller as they extend inward in the radial direction R. The interval between the pair of side surfaces 74A is a groove width W1 of the first groove 74, and becomes continuously smaller as it approaches the rear end of the first groove 74 (see also FIG. 6). The bottom surface 74B is inclined with respect to the rotational axis 15A so as to be deviated more outwardly in the radial direction R as it extends rearward.

A plurality of second grooves 75 (more specifically, the number of second grooves 75 is equal to the number of fourth projections 64, for example) are provided, and are arranged at equal or substantially equal intervals between the second grooves 75 along the rotation direction S. A front end and a rear end of the second groove 75 are open at the second front end surface 72C and the second rear end surface 72D of the second damper 72, respectively. An inner surface of the second groove 75 includes a pair of side surfaces 75A extending in the front-rear direction and in the radial direction R and a bottom surface 75B that couples together inner ends in the radial direction R of the pair of side surfaces 75A (see FIG. 6). The pair of side surfaces 75A extend inwardly in the radial direction R from the second outer peripheral surface 72B of the second damper 72. The pair of side surfaces 75A are inclined surfaces the interval between which becomes continuously smaller as they extend inward in the radial direction R. The interval between the pair of side surfaces 75A is a groove width W2 of the second groove 75, and may become continuously larger or smaller as it approaches the rear end of the second groove 75, and may be the same at any position in the front-rear direction. The groove width W2 is wider than the groove width W1 of the first groove 74, and is equal to, for example, twice or more as much as the groove width W1. The bottom surface 75B is inclined with respect to the rotational axis 15A so as to be deviated more outwardly in the radial direction R as it extends rearward.

A projection 72E that protrudes outwardly in the radial direction R and that extends in the front-rear direction is provided between the second grooves 75 adjoining in the rotation direction S one by one. An outer forward end surface 72F of the projection 72E in the radial direction R defines the second outer peripheral surface 72B of the second damper 72.

A plurality of third grooves 76 (more specifically, the number of third grooves 76 is equal to the number of projections 72E) are provided, and are arranged at equal or substantially equal intervals between the third grooves 76 along the rotation direction S. The third groove 76 is provided at the center in the rotation direction S of the forward end surface 72F of the projection 72E one by one. The second groove 75 and the third groove 76 are alternately arranged along the rotation direction S. A front end and a rear end of the third groove 76 are open at the second front end surface 72C and the second rear end surface 72D of the second damper 72, respectively. The groove width of the third groove 76 is smaller than the groove width W2 of the second groove 75.

Figure 9:
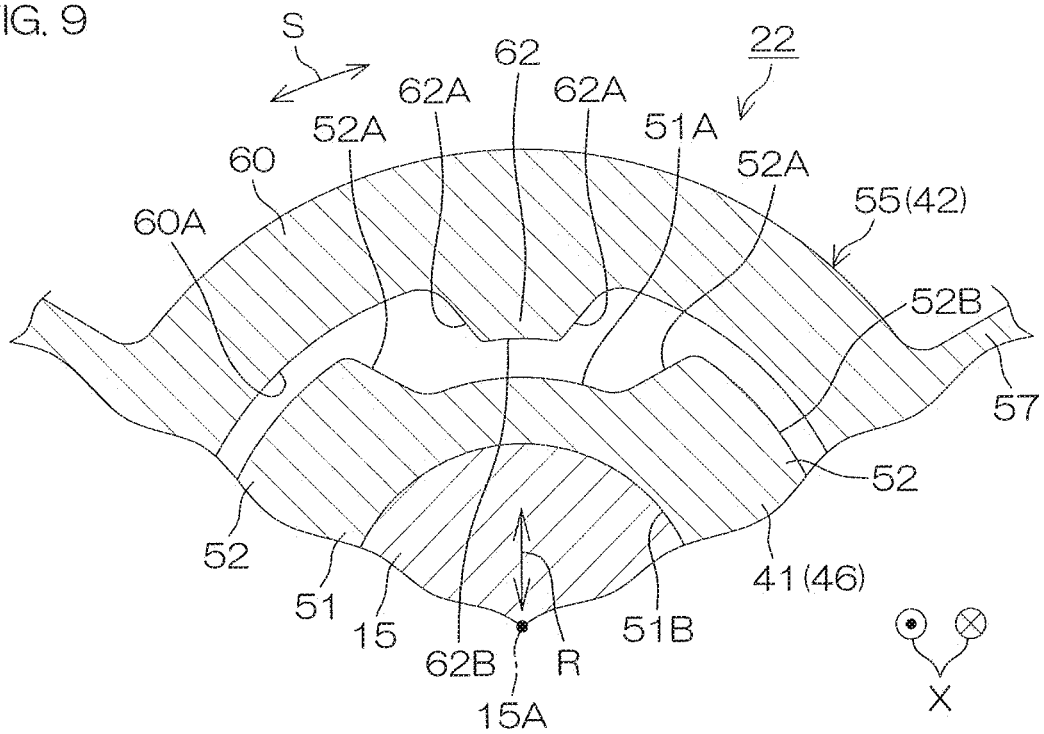
FIG. 9 is a cross-sectional view of a main portion of the propeller along line A-A of FIG. 2.

The entirety of the propeller damper 45 including the first and second dampers 71 and 72 is located between the first cylinder portion 51 of the bushing 41 and the second cylinder portion 60 of the propeller body 42 with respect to the radial direction R (see FIG. 2). The first projection 52 of the bushing 41 and the second projection 62 of the second cylinder portion 60 are alternately arranged along the rotation direction S (see FIG. 9).

Figure 10:
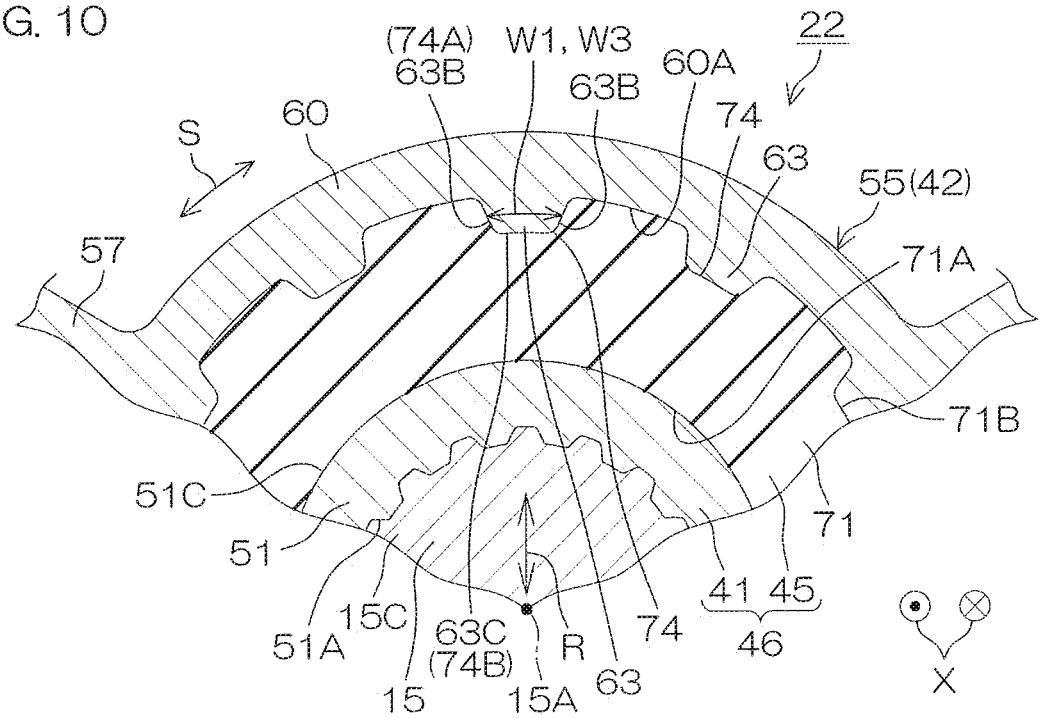
FIG. 10 is a cross-sectional view of the main portion of the propeller along line B-B of FIG. 2.

The third projection 63 of the second cylinder portion 60 engages and interlocks with the first groove 74 of the first damper 71 one by one (see FIG. 10). The groove width W1 of the first groove 74 is equal to or less than the width W3 of the third projection 63 in the rotation direction S, and therefore each of the third projections 63 is press fitted into the first groove 74. Therefore, the pair of side surfaces 63B of the third projection 63 are pressed against the pair of side surfaces 74A of the first groove 74, respectively. Additionally, the forward end surface 63C of the third projection 63 comes into contact with the bottom surface 74B of the first groove 74.

Figure 11:
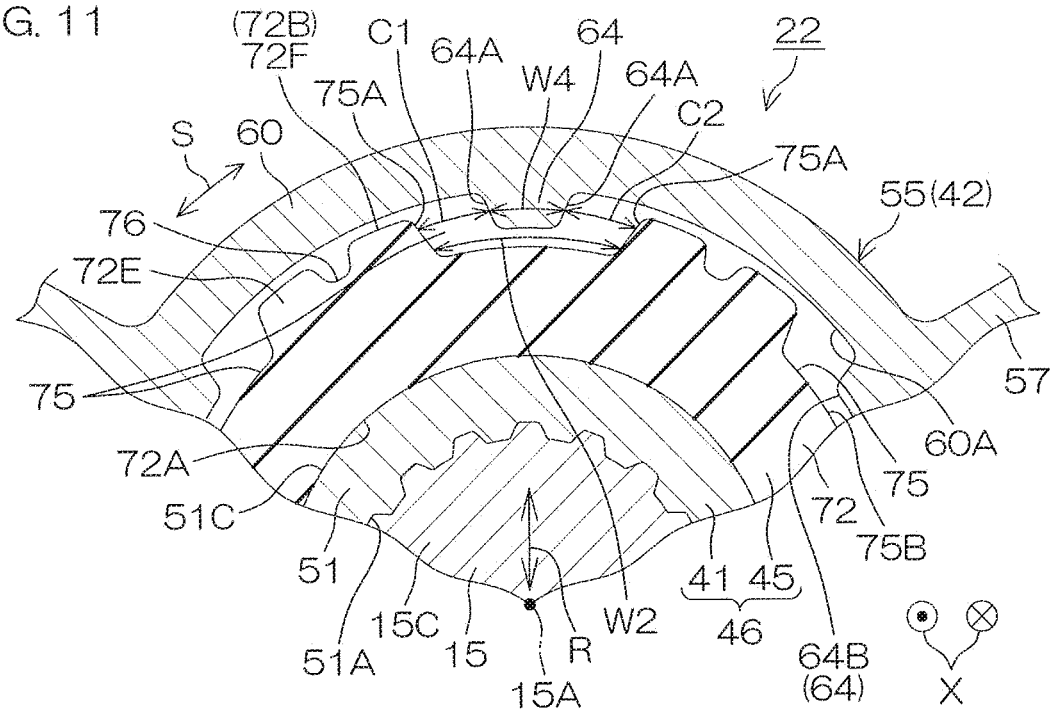
FIG. 11 is a cross-sectional view of the main portion of the propeller along line C-C of FIG. 2.

The fourth projection 64 of the second cylinder portion 60 engages and interlocks with the second groove 75 of the second damper 72 one by one (see FIG. 11). The groove width W2 of the second groove 75 is wider than a width W4 of the fourth projection 64 in the rotation direction S, and therefore each of the fourth projections 64 is fitted in the second groove 75 while having a clearance in the rotation direction S. The forward end surface 64B of the fourth projection 64 is spaced outwardly from the bottom surface 75B of the second groove 75 in the radial direction R. The second outer peripheral surface 72B of the second damper 72 is spaced inwardly from the inner peripheral surface 60A of the second cylinder portion 60 in the radial direction R. Nothing is fitted in the third groove 76.

The propeller body 42 coupled to the bushing 41 through the propeller damper 45 in the above-described way is relatively movable in the rotation direction S with respect to the bushing 41 and the propeller shaft 15. The propeller body 42 is in a non-contact position when torque (hereinafter, referred to as "rotational torque") that relatively rotates the propeller shaft 15 and the propeller body 42 is not generated.

At this time, the first projection 52 of the bushing 41 and the second projection 62 of the second cylinder portion 60 are spaced away from each other in the rotation direction S (see FIG. 9), and the fourth projection 64 of the second cylinder portion 60 is located at the center in the rotation direction S of the second groove 75 of the second damper 72, and is spaced away from the pair of side surfaces 75A of the second groove 75 (see FIG. 11). At this time, the center of the fourth projection 64 and the center of the second groove 75 are located at the same position in the rotation direction S. Therefore, a gap C1 in the rotation direction S between the fourth projection 64 and one of the side surfaces 75A of the second groove 75 and a gap C2 in the rotation direction S between the fourth projection 64 and the remaining side surface 75A of the second groove 75 are equal to each other in size.

In other words, when rotational torque is not generated, the bushing 41 and the second damper 72 are spaced away from the propeller body 42, and the first damper 71 is in contact with the propeller body 42 (see FIG. 10). Therefore, the propeller body 42 is elastically supported by the bushing 41 only through the first damper 71.

When rotational torque is generated, the rotational torque is transmitted between the bushing 41 and the propeller body 42 through a contact portion between the third projection 63 of the propeller body 42 and the first groove 74 of the first damper 71. Additionally, the first damper 71 is twisted by the rotational torque so that its outer and inner peripheral portions relatively rotate, and the first damper 71 is elastically deformed. The bushing 41 and the propeller body 42 relatively rotate at an angle (hereinafter, referred to as a "twist angle") corresponding to the elastic deformation volume of the first damper 71.

Figure 12:
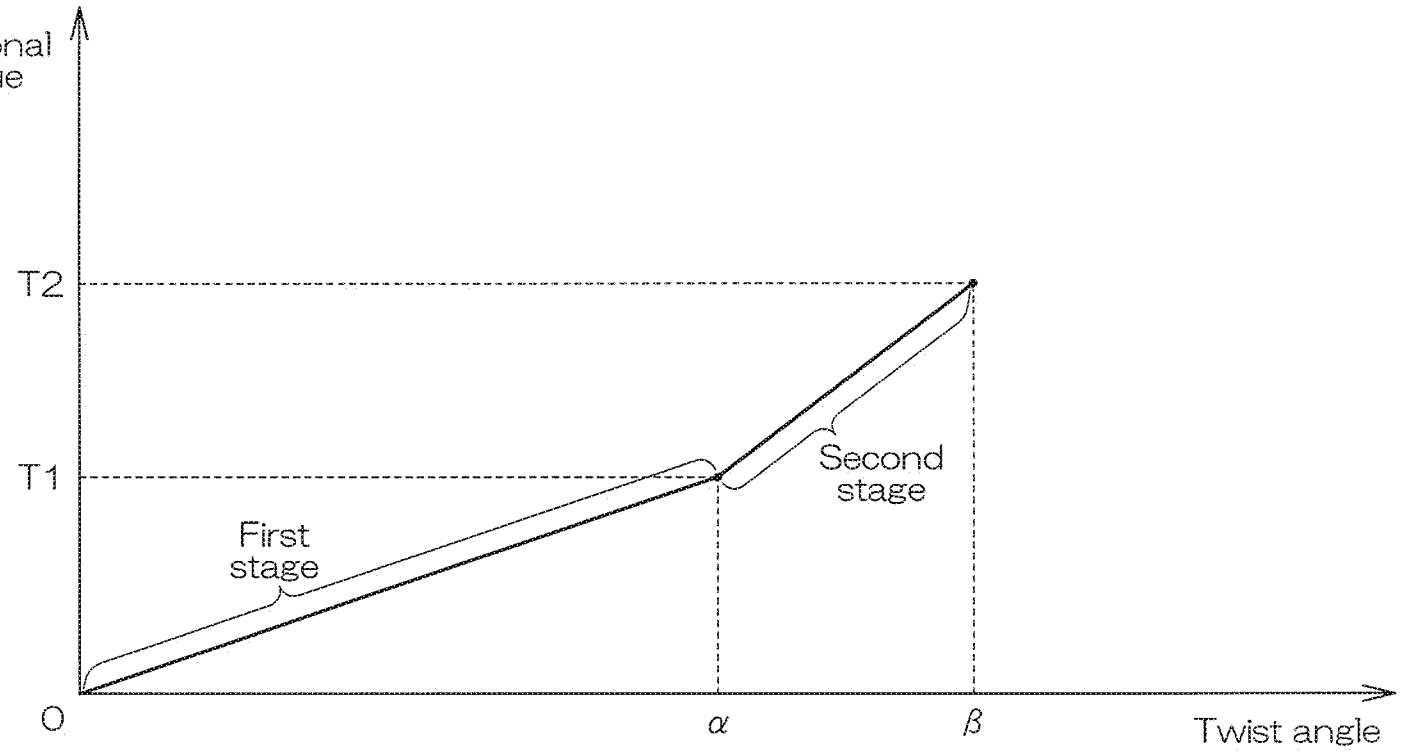
FIG. 12 is a graph showing a relationship between a twist angle and rotational torque in the propeller.

FIG. 12 is a graph showing a relationship between the twist angle and the rotational torque in the propeller 22. In this graph, the abscissa axis represents the twist angle, and the ordinate axis represents the rotational torque.

Figure 13:
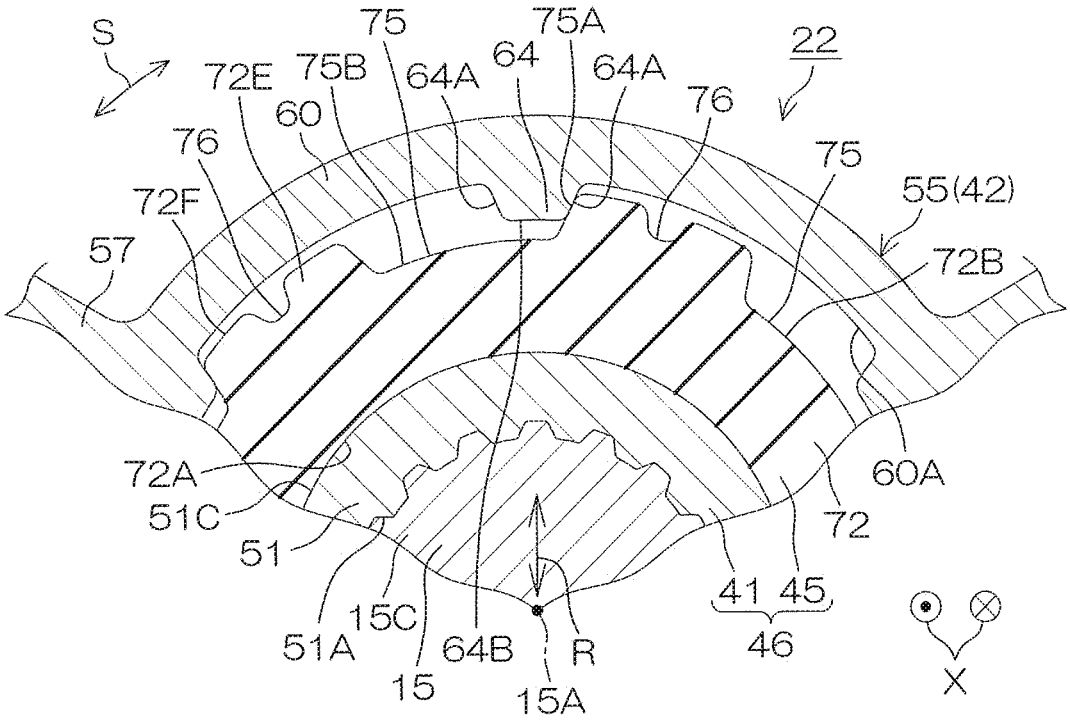
FIG. 13 corresponds to FIG. 11, and is a cross-sectional view of the main portion of the propeller in a state in which rotational torque is being applied.

In a range in which the magnitude of the rotational torque is less than a first torque T1, this torque is transmitted between the bushing 41 and the inner cylinder 55 only by the first damper 71. When the rotational torque reaches the first torque T1, the twist angle of the propeller damper 45 increases to a first angle α. Thus, the propeller body 42 relatively rotates from a non-contact position to an intermediate position. As a result, the side surface 64A of the fourth projection 64 of the propeller body 42 comes into contact with the side surface 75A of the second groove 75 of the second damper 72, i.e., comes into contact with the projection 72E as shown in FIG. 13. Therefore, the rotational torque is transmitted between the bushing 41 and the propeller body 42 also through a contact portion between the fourth projection 64 and the second groove 75. In other words, the rotational torque is transmitted by both of the first and second dampers 71 and 72. The projection 72E easily undergoes elastic deformation in the rotation direction S due to the third groove 76.

Figure 14:
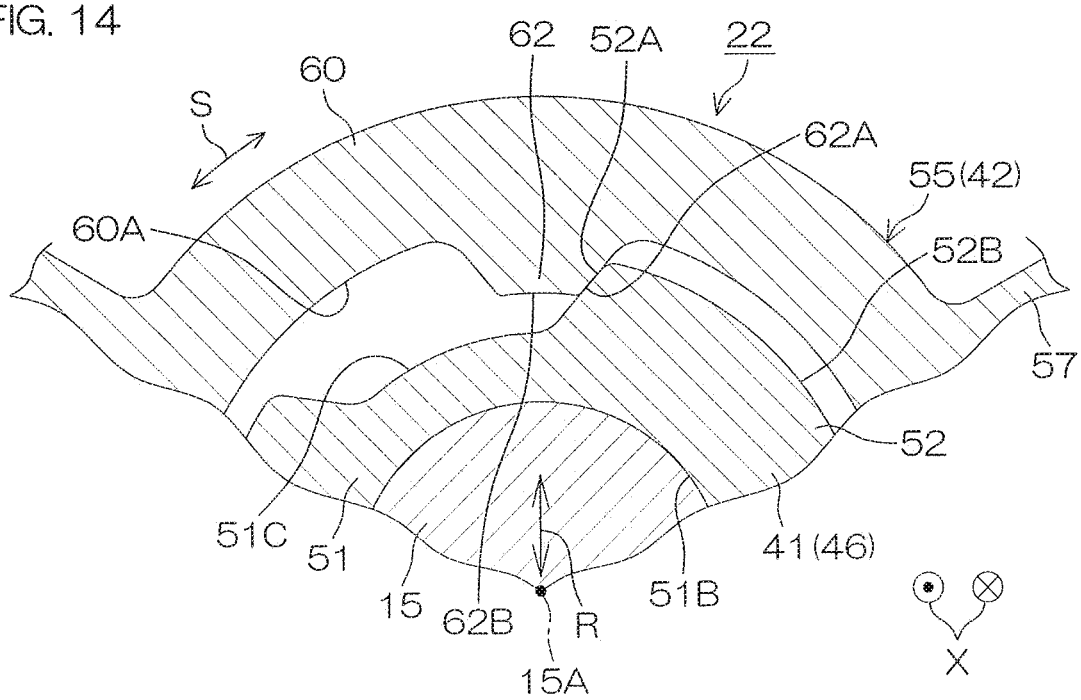
FIG. 14 corresponds to FIG. 9, and is a cross-sectional view of the main portion of the propeller in a state in which rotational torque is being applied.

In a range in which the magnitude of the rotational torque is the first torque T1 or more and is less than a second torque T2, the first projection 52 of the bushing 41 continues to be spaced away from the second projection 62 of the inner cylinder 55, and therefore the rotational torque is transmitted only by the first and second dampers 71 and 72. When the rotational torque reaches the second torque T2, the twist angle of the propeller damper 45 increases to a second angle R. Thus, the propeller body 42 relatively rotates from the intermediate position to a contact position. Thereupon, the side surface 52A of the first projection 52 of the bushing 41 comes into contact (metal touch) with the side surface 62A of the second projection 62 of the propeller body 42 as shown in FIG. 14. Therefore, the rotational torque is transmitted between the bushing 41 and the propeller body 42 by the first and second projections 52 and 62 in addition to the first and second dampers 71 and 72. Thus, the first damper 71 transmits the rotational torque between the bushing 41 and the propeller body 42 regardless of the magnitude of the rotational torque.

When the magnitude of the rotational torque is the second torque T2 or more, the relative rotation of both the bushing 41 and the propeller body 42 is regulated by contact between the first projection 52 and the second projection 62, and therefore the twist angle of the propeller damper 45 is kept at the second angle R. The bushing 41 and the propeller body 42 rotate together in this state. Thus, the rotational torque is efficiently transmittable between the propeller shaft 15 and the propeller body 42.

When the rotational torque decreases to zero, the twist angle returns to zero, and the propeller body 42 returns from the contact position to the non-contact position. Thus, the propeller body 42 is relatively rotatable between the contact position and the non-contact position.

As described above, according to a preferred embodiment of the present invention, the propeller damper 45 between the first cylinder portion 51 of the bushing 41 and the second cylinder portion 60 of the propeller body 42 is elastically deformed when torque that causes the propeller body 42 and the bushing 41 to relatively rotate is generated in a state in which the propeller body 42 is in the non-contact position. When the propeller damper 45 is elastically deformed until the first projection 52 of the first cylinder portion 51 and the second projection 62 of the second cylinder portion 60 come into contact with each other, the propeller body 42 is located at the contact position, and the propeller body 42 and the bushing 41 rotate together.

The propeller damper 45 includes the first and second dampers 71 and 72. The first inner peripheral surface 71A of the first damper 71 and the second inner peripheral surface 72A of the second damper 72 are each attached or bonded to the outer peripheral surface 51C of the first cylinder portion 51. The third projection 63 of the second cylinder portion 60 is press fitted into the first groove 74 provided at the first outer peripheral surface 71B of the first damper 71, whereas the fourth projection 64 of the second cylinder portion 60 has a clearance in the rotation direction S and is located at the second groove 75 provided at the second outer peripheral surface 72B of the second damper 72. Therefore, until the propeller body 42 is located at the contact position when a rotational torque is generated, the first damper 71 is elastically deformed first, and then the second damper 72 is elastically deformed thereafter by allowing the fourth projection 64 to come into contact with the side surface of the second groove 75. Thus, the propeller damper 45 is able to be elastically deformed in a stepwise manner.

More specifically, only the first damper 71 is elastically deformed in a first stage in which the twist angle reaches the first angle α, and both of the first and second dampers 71 and 72 are elastically deformed in a second stage in which the twist angle that has reached the first angle α reaches the second angle β as shown in FIG. 12. The elastic deformation of the first damper 71 in the first stage is primarily used to prevent the rattling noise. The elastic deformation of the first damper 71 and the elastic deformation of the second damper 72 in the second stage subsequent to the first stage are primarily used to prevent shift shock.

Particularly, the first and second dampers 71 and 72 are separated from each other by the separation portion 73 at least in the first and second outer peripheral surfaces 71B and 72B, and are individually elastically deformable. Therefore, when the first damper 71 is elastically deformed in the first stage, it is possible to prevent the second damper 72 from being elastically deformed together with the first damper 71. Additionally, it is possible to start the elastic deformation of the second damper 72 at the second stage. This makes it possible to clearly change and distinguish the characteristics of the propeller damper 45 from the characteristics in the first stage so as to balance the large rotational torque caused by a shift shock in the second stage even if the elastic modulus of the entirety of the propeller damper 45 is set at a low value to prevent the rattling noise. Therefore, it is possible to emphasize the function of the second damper 72 to prevent shift shock in the second stage.

As a consequence of these capabilities, both prevention of the rattling noise and shift shock are compatibly achieved in the propeller 22.

In a preferred embodiment of the present invention, the separation portion 73 completely separates the first and second dampers 71 and 72 from each other by extending through the propeller damper 45 along the radial direction R (see FIG. 2).

This structural arrangement makes it possible to further prevent the second damper 72 from being elastically deformed at the same time when the first damper 71 is elastically deformed in the first stage, and makes it possible to reliably start the elastic deformation of the second damper 72 at the second stage. Therefore, the second damper 72 is able to further emphasize its role (shift-shock prevention) in the second stage. Therefore, both prevention of the rattling noise and shift shock are further compatibly achieved in the propeller 22.

In a preferred embodiment of the present invention, the groove width W2 of the second groove 75 is wider than the groove width W1 of the first groove 74.

This structural arrangement makes it possible to press fit the third projection 63 into the first groove 74 while locating the fourth projection 64 in the second groove 75 with a clearance in the rotation direction S if the width W3 of the third projection 63 that engages and interlocks with the first groove 74 and the width W4 of the fourth projection 64 that engages and interlocks with the second groove 75 are equal or be substantially equal to each other.

Although the first and second dampers 71 and 72 preferably have the same rigidity, i.e., in elastic modulus in a preferred embodiment of the present invention, these dampers may differ from each other in elastic modulus. For example, the second damper 72 may have a higher elastic modulus, and thus may be harder than the first damper 71. This structural arrangement makes it possible to primarily use the elastic deformation of the first damper 71 in the first stage to prevent a rattling noise and primarily use the elastic deformation of the second damper 72 in the second stage to prevent a shift shock that may be caused in a situation in which the torque is larger than when a rattling noise occurs. Particularly, it is possible to greatly increase the rotational torque in the second stage of the propeller damper 45 (see FIG. 12), so that the propeller damper 45 is able to accommodate the large rotational torque of a shift shock.

Figure 15:
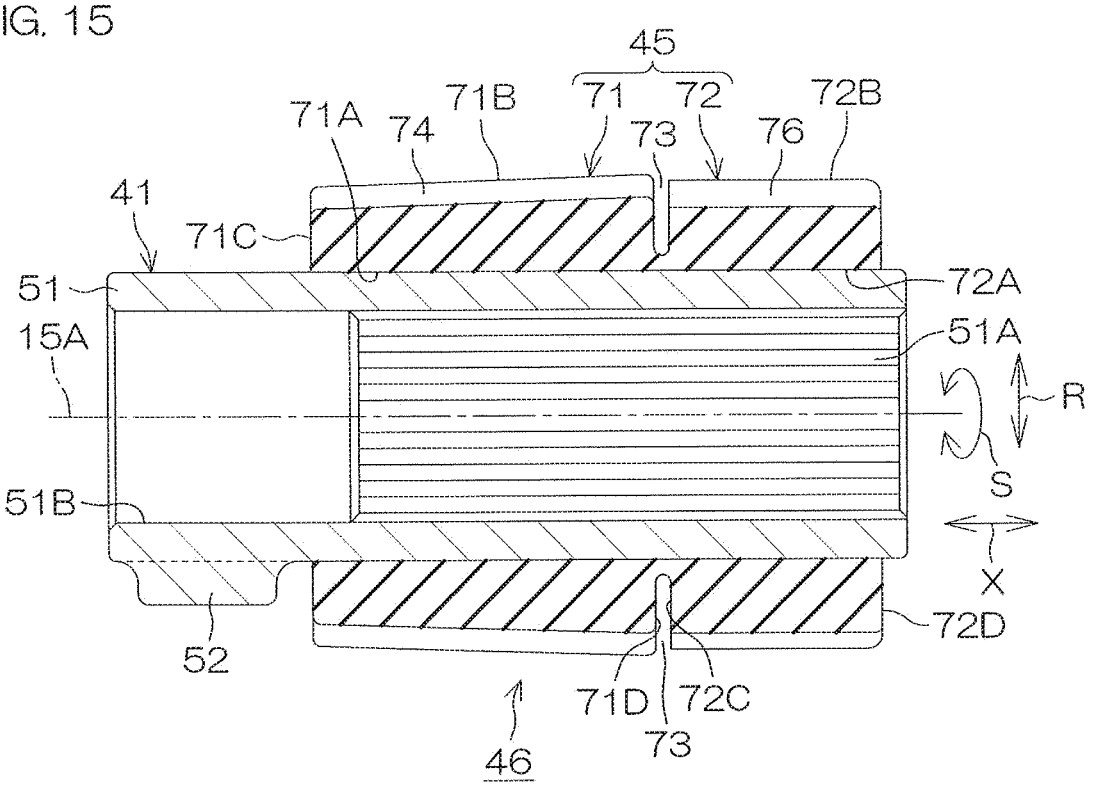
FIG. 15 is a longitudinal sectional view of a damper unit according to a first preferred modification.
Figure 16:
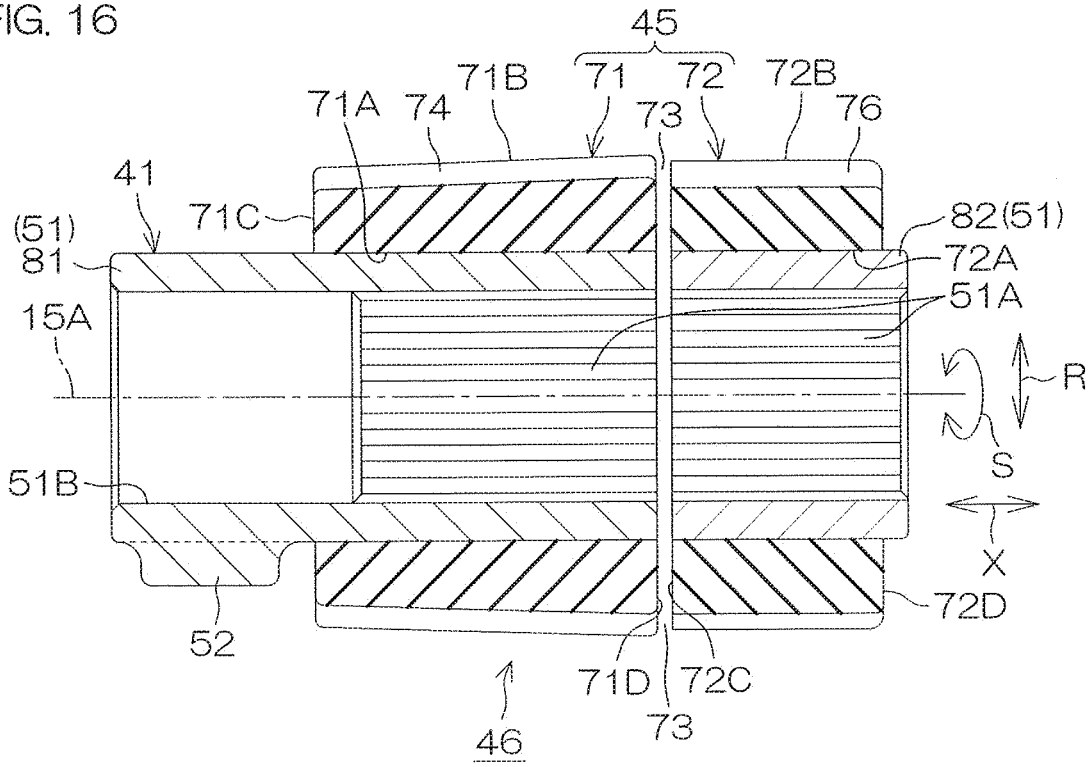
FIG. 16 is a longitudinal sectional view of a damper unit according to a second preferred modification.

FIG. 15 is a longitudinal sectional view of the damper unit 46 according to a first preferred modification. FIG. 16 is a longitudinal sectional view of the damper unit 46 according to a second preferred modification. In FIG. 15 and FIG. 16, the same reference number is given to a component functionally equivalent to each component described above, and a detailed description of this component is omitted.

If the first and second dampers 71 and 72 are individually elastically deformable, as shown in FIG. 15, the separation portion 73 is not necessarily required to extend through the propeller damper 45 along the radial direction R. In that case, the first and second dampers 71 and 72 have their inner peripheral portions connected to each other, and thus are not completely separated from each other, and the first inner peripheral surface 71A of the first damper 71 and the second inner peripheral surface 72A of the second damper 72 are continuous with each other.

As shown in FIG. 16, the first cylinder portion 51 of the bushing 41 may be completely divided into a first divided cylinder portion 81 to which the first inner peripheral surface 71A of the first damper 71 is attached or bonded and a second divided cylinder portion 82 to which the second inner peripheral surface 72A of the second damper 72 is attached or bonded. In this case, the relative position in the rotation direction S between the first divided cylinder portion 81 and the second divided cylinder portion 82 is changeable.

This structural arrangement makes it possible to adjust the position of the fourth projection 64 of the propeller body 42 in the second groove 75 of the second damper 72 by allowing an operator to change the relative position in the rotation direction S between the first and second divided cylinder portions 81 and 82. Therefore, the operator is able to easily perform the phase adjustment between the first and second dampers 71 and 72, and is able to adjust the gap C1 and the gap C2 described above by gauging (see FIG. 11). This enables the operator to adjust the timing at which the rotational torque is generated and at which the fourth projection 64 comes into contact with the side surface 75A of the second groove 75, i.e., the timing at which the second damper 72 starts elastic deformation. For example, let it be supposed that the bushing 41 and the propeller body 42 relatively rotate so that the gap C1 becomes small and the gap C2 becomes large when the shift position of the outboard motor 5 is shifted in "forward movement." It is possible to advance the timing at which the second damper 72 operates if the gap C1 is made smaller than the gap C2 although the gap C1 and the gap C2 are the same in the above-described preferred embodiments when the shift position of the outboard motor 5 is in "neutral" (see FIG. 11). On the contrary, it is possible to delay the timing at which the second damper 72 operates if the gap C1 is made larger than the gap C2 when the shift position of the outboard motor 5 is in "neutral."

Additionally, the propeller damper 45 may include not only the first and second dampers 71 and 72 but also a third damper, and dampers subsequent to the third damper. The third and subsequent dampers are likewise configured to be individually elastically-deformable due to the separation portion 73 in the same way as in the first and second dampers 71 and 72. Additionally, each damper that is an element of the propeller damper 45 may be configured not by a cylindrical separator continuous in the rotation direction S but by a plurality of separators arranged in the rotation direction S.

Additionally, the dog clutch 25 may be provided at the drive shaft 14 although the dog clutch 25 is provided at the propeller shaft 15 in a preferred embodiment described above (see FIG. 1). In this case, for example, the drive shaft 14 is divided into an upper first shaft and a lower second shaft, and the rotary body 24 is provided at a lower end portion of the first shaft, and the dog clutch 25 is configured so as to be attachable/detachable to/from the rotary body 24 by sliding an upper end portion of the second shaft.

Additionally, an inboard/outboard motor or an inboard motor may be used as an example of the vessel propulsion apparatus 1 other than the outboard motor 5. The inboard/outboard motor is a motor in which a prime mover is disposed inside the vessel and in which a drive unit, which includes a thrust generating member, such as the propeller 22, and a steering, is disposed outside the vessel. The inboard motor has both the prime mover and the drive unit built into the hull 3 and in which the propeller 22 is attached to the propeller shaft that extends from the drive unit toward the outside of the vessel. In this case, the steering is provided separately.

Various features described above may be appropriately combined together.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A propeller for a vessel propulsion apparatus to rotate together with a propeller shaft provided in the vessel propulsion apparatus, the propeller comprising:

a bushing to be fixed to the propeller shaft;

a propeller body; and a propeller damper; wherein the bushing includes:

a first cylinder portion surrounding the propeller shaft; and a first projection protruding outwardly in a radial direction of the propeller from an outer peripheral surface of the first cylinder portion;

the propeller body includes:

a second cylinder portion surrounding the bushing;

a second projection protruding inwardly in the radial direction from an inner peripheral surface of the second cylinder portion and located beside the first projection along a rotation direction of the propeller;

a third projection protruding inwardly in the radial direction from an inner peripheral surface of the second cylinder portion at a position different from a position of the second projection;

a fourth projection protruding inwardly in the radial direction from the inner peripheral surface of the second cylinder portion at a position different from the position of the second projection and from a position of the third projection with respect to an axial direction of the propeller; and a plurality of blades each located at a more outward position than the second cylinder portion with respect to the radial direction of the propeller and arranged along the rotation direction;

the propeller body is movable in the rotation direction with respect to the bushing between a non-contact position at which the first projection and the second projection are spaced away from each other and a contact position at which the first projection and the second projection come into contact with each other;

the propeller damper includes a first damper and a second damper located side by side along the axial direction between the first cylinder portion and the second cylinder portion and separated from each other by a separation portion so as to be individually elastically deformable;

the first damper includes:

a first inner peripheral surface attached to the outer peripheral surface of the first cylinder portion; and a first outer peripheral surface including a first groove with a groove width equal to or less than a width of the third projection in the rotation direction, and that extends in the axial direction and engages and interlocks with the third projection;

the second damper includes:

a second inner peripheral surface attached to the outer peripheral surface of the first cylinder portion; and a second outer peripheral surface including a second groove with a groove width wider than a width of the fourth projection in the rotation direction, and that extends in the axial direction and engages and interlocks with the fourth projection; and the separation portion separates the first outer peripheral surface and the second outer peripheral surface from each other;

when the propeller body is moved in the rotation direction with respect to the bushing:

a first torque is transmitted from the bushing to the propeller body through the first damper; and a second torque is transmitted from the bushing to the propeller body through the second damper without the second torque passing through the first damper;

the first cylinder portion is divided into a first divided cylinder portion to which the first inner peripheral surface is attached and a second divided cylinder portion to which the second inner peripheral surface is attached; and a relative position between the first divided cylinder portion and the second divided cylinder portion in the rotation direction is changeable.

2. The propeller according to claim 1, wherein the separation portion includes an annular groove that completely separates the first damper and the second damper from each other by extending through the propeller damper along the radial direction.

3. The propeller according to claim 1, wherein the first inner peripheral surface and the second inner peripheral surface are adhered to the outer peripheral surface of the first cylinder portion.

4. The propeller according to claim 1, wherein the first damper and the second damper each have a cylindrical shape and surround the bushing.

5. The propeller according to claim 1, wherein the second damper is harder than the first damper.

6. The propeller according to claim 1, wherein the groove width of the second groove is wider than the groove width of the first groove.

7. The propeller according to claim 1, wherein the propeller body includes an inner cylinder including the second cylinder portion and an outer cylinder including the plurality of blades and surrounding the inner cylinder.

8. The propeller according to claim 1, wherein the third projection and the fourth projection are unitary.

9. A vessel propulsion apparatus comprising:

the propeller of claim 1;

the propeller shaft that rotates together with the propeller;

an engine;

a drive shaft that is rotatable by the engine; and a transmission to transmit rotation of the drive shaft to the propeller shaft; wherein the transmission includes:

a rotary body to rotate together with the rotation of the drive shaft; and a dog clutch movable between a connection position at which the dog clutch engages with the rotary body and a disconnection position at which the dog clutch is spaced away from the rotary body and rotates together with the propeller shaft.

10. The vessel propulsion apparatus according to claim 9, wherein the rotary body includes a first rotary body and a second rotary body located side by side in the axial direction and that rotate in mutually opposite directions around a rotational axis of the propeller shaft;

the dog clutch is movable along the axial direction; and the connection position includes a first connection position at which the dog clutch engages only with the first rotary body and a second connection position at which the dog clutch engages only with the second rotary body.

11. The propeller according to claim 1, wherein the first cylinder portion is in direct contact with the propeller shaft.

12. A propeller for a vessel propulsion apparatus to rotate together with a propeller shaft provided in the vessel propulsion apparatus, the propeller comprising:

a bushing to be fixed to the propeller shaft;

a propeller body; and a propeller damper; wherein the bushing includes:

a first cylinder portion surrounding the propeller shaft; and a first projection protruding outwardly in a radial direction of the propeller from an outer peripheral surface of the first cylinder portion;

the propeller body includes:

a second cylinder portion surrounding the bushing;

a second projection protruding inwardly in the radial direction from an inner peripheral surface of the second cylinder portion and located beside the first projection along a rotation direction of the propeller;

a third projection protruding inwardly in the radial direction from an inner peripheral surface of the second cylinder portion at a position different from a position of the second projection;

a fourth projection protruding inwardly in the radial direction from the inner peripheral surface of the second cylinder portion at a position different from the position of the second projection and from a position of the third projection with respect to an axial direction of the propeller; and a plurality of blades each located at a more outward position than the second cylinder portion with respect to the radial direction of the propeller and arranged along the rotation direction;

the propeller body is movable in the rotation direction with respect to the bushing between a non-contact position at which the first projection and the second projection are spaced away from each other and a contact position at which the first projection and the second projection come into contact with each other;

the propeller damper includes a first damper and a second damper located side by side along the axial direction between the first cylinder portion and the second cylinder portion and separated from each other by a separation portion so as to be individually elastically deformable;

the first damper includes:

a first inner peripheral surface attached to the outer peripheral surface of the first cylinder portion; and a first outer peripheral surface including a first groove with a groove width equal to or less than a width of the third projection in the rotation direction, and that extends in the axial direction and engages and interlocks with the third projection;

the second damper includes:

a second inner peripheral surface attached to the outer peripheral surface of the first cylinder portion; and a second outer peripheral surface including a second groove with a groove width wider than a width of the fourth projection in the rotation direction, and that extends in the axial direction and engages and interlocks with the fourth projection; and the separation portion separates the first outer peripheral surface and the second outer peripheral surface from each other;

when the propeller body is moved in the rotation direction with respect to the bushing:

a first torque is transmitted from the bushing to the propeller body through the first damper; and a second torque is transmitted from the bushing to the propeller body through the second damper without the second torque passing through the first damper; and the separation portion includes an annular groove that does not completely separate the first damper and the second damper from each other by extending only partially through the propeller damper along the radial direction.

* * * * *